US006046716A

United States Patent [19]

McKnight

[11] Patent Number: 6,046,716

[45] Date of Patent: Apr. 4, 2000

[54] DISPLAY SYSTEM HAVING ELECTRODE MODULATION TO ALTER A STATE OF AN ELECTRO-OPTIC LAYER

[75] Inventor: Douglas McKnight, Boulder, Colo.

[73] Assignee: Colorado MicroDisplay, Inc., Boulder, Colo.

[21] Appl. No.: 08/994,033

[22] Filed: Dec. 18, 1997

Related U.S. Application Data

[63] Continuation-in-part of application No. 08/801,994, Feb. 18, 1997, which is a continuation-in-part of application No. 08/770,233, Dec. 19, 1996, Pat. No. 5,920,298, and a continuation-in-part of application No. 08/920,602, Aug. 27, 1997, and a continuation-in-part of application No. 08/920,603, Aug. 27, 1997

[60] Provisional application No. 60/065,087, Nov. 11, 1997.

[51] Int. Cl.[7] ..... G09G 3/36

[52] U.S. Cl. ..... 345/95; 345/94; 345/208; 345/210

[58] Field of Search ..... 345/94, 95, 89, 345/208, 210

[56] References Cited

U.S. PATENT DOCUMENTS

| | | | |
|---|---|---|---|
| H2 | 12/1985 | Soloway | 340/701 |
| H1320 | 6/1994 | Kieronski | 359/48 |
| 3,097,260 | 7/1963 | James | 178/5.4 |

(List continued on next page.)

FOREIGN PATENT DOCUMENTS

| | | |
|---|---|---|
| 0298255 | 1/1989 | European Pat. Off. . |
| 0336351 | 10/1989 | European Pat. Off. . |
| 0373565 | 6/1990 | European Pat. Off. . |

(List continued on next page.)

OTHER PUBLICATIONS

H. Okada, et al., "An 8.4–in. TFT–LCD System for a Note–Size Computer Using 3–Bit Digital Data Drivers, "*Japan Display* (1992), pp. 475–478.

Uchida, Tatsuo, "Application and Device Modeling of Liquid Crystal Displays", Mol. Cryst. Liq. Cryst., vol. 123, 1985, pp. 15–55.

Bahadur, Birendra, "Liquid Crystal Displays", Molecular Crystals and Liquid Crystals, vol. 109, No. 1, 1984, p. 32.

(List continued on next page.)

*Primary Examiner*—Richard A. Hjerpe
*Assistant Examiner*—Anthony J. Blackman
*Attorney, Agent, or Firm*—Blakely, Sokoloff, Taylor & Zafman

[57] ABSTRACT

Methods and systems for operating a display system. An example of the display system includes a first substrate having a plurality of pixel electrodes, an electro-optic layer operatively coupled to the pixel electrodes and an electrode operatively coupled to said electro-optic layer. In one example of a method of the invention, a first plurality of pixel data values is applied to the plurality of pixel electrodes. A first control voltage is applied to the electrode to alter a state of the electro-optic layer such that the first pixel data represented by the first plurality of pixel data values is substantially not displayed. A second plurality of pixel data values, representing a second pixel data, is applied to the plurality of pixel electrodes, and a second control voltage is applied to the electrode to alter the state of the electro-optic layer such that the second pixel data is displayed. In an example of a first aspect of the invention, a voltage difference between the first control voltage and the second control voltage is reduced to reduce capacitive shifting of the second plurality of pixel data values on the plurality of pixel electrodes. In an example of a second aspect of the invention, at least one of the first control voltage, the second control voltage and a pixel data value of the second plurality of pixel data values is determined by an illumination color used in displaying said second pixel data. In an example of a third aspect of the invention, the electrode receives a composite signal over time, and a first parameter of at least one of the first control voltage and the second control voltage is selected to provide an offset, for a portion of the composite signal, from a DC balanced signal over time with respect to a particular voltage.

104 Claims, 19 Drawing Sheets

U.S. PATENT DOCUMENTS

| | | | |
|---|---|---|---|
| 3,507,982 | 4/1970 | Sugihara | 178/5.4 |
| 3,651,511 | 3/1972 | Andrews et al. | 340/324 R |
| 3,703,329 | 11/1972 | Castellano | 350/150 |
| 3,758,195 | 9/1973 | Hedman, Jr. et al. | 350/160 |
| 3,813,145 | 5/1974 | Hedman, Jr. et al. | 350/160 |
| 3,856,381 | 12/1974 | Hedman, Jr. et al. | 350/160 |
| 3,898,646 | 8/1975 | Washizuka et al. | 340/336 |
| 3,902,169 | 8/1975 | Washizuka | 340/336 |
| 3,938,134 | 2/1976 | Hackstein et al. | 340/324 M |
| 4,019,178 | 4/1977 | Hashimoto et al. | 340/324 |
| 4,082,430 | 4/1978 | Schulthess et al. | 350/333 |
| 4,090,219 | 5/1978 | Ernstoff et al. | 358/59 |
| 4,150,396 | 4/1979 | Hareng et al. | 358/60 |
| 4,240,113 | 12/1980 | Michael et al. | 358/180 |
| 4,315,258 | 2/1982 | McKnight et al. | 340/784 |
| 4,319,237 | 3/1982 | Matsuo et al. | 340/713 |
| 4,335,393 | 6/1982 | Pearson | 358/4 |
| 4,364,039 | 12/1982 | Penz | 340/784 |
| 4,378,955 | 4/1983 | Bleha, Jr. et al. | 350/334 |
| 4,385,806 | 5/1983 | Fergason | 350/347 |
| 4,416,514 | 11/1983 | Plummer | 350/335 |
| 4,432,610 | 2/1984 | Kobayashi et al. | 350/331 R |
| 4,449,123 | 5/1984 | Muranaga | 340/716 |
| 4,451,825 | 5/1984 | Hall et al. | 340/750 |
| 4,455,576 | 6/1984 | Hoshi | 358/230 |
| 4,464,018 | 8/1984 | Gagnon | 350/331 R |
| 4,487,480 | 12/1984 | Nonomura et al. | 350/335 |
| 4,566,758 | 1/1986 | Bos | 350/346 |
| 4,574,282 | 3/1986 | Crossland et al. | 340/784 |
| 4,582,396 | 4/1986 | Bos et al. | 350/347 |
| 4,595,259 | 6/1986 | Perregaux | 350/331 |
| 4,635,051 | 1/1987 | Bos | 340/757 |
| 4,652,087 | 3/1987 | Bos et al. | 350/332 |
| 4,652,912 | 3/1987 | Masubuchi | 358/59 |
| 4,675,667 | 6/1987 | Nakamura et al. | 340/784 |
| 4,676,602 | 6/1987 | Watanabe | 350/332 |
| 4,709,995 | 12/1987 | Kuribayashi et al. | 350/350 S |
| 4,716,403 | 12/1987 | Morozumi | 340/702 |
| 4,768,092 | 8/1988 | Ishikawa | 358/140 |
| 4,769,639 | 9/1988 | Kawamura et al. | 340/784 |
| 4,770,500 | 9/1988 | Kalmanash et al. | 350/347 E |
| 4,773,026 | 9/1988 | Takahara et al. | 364/518 |
| 4,808,991 | 2/1989 | Tachiuchi et al. | 340/793 |
| 4,822,142 | 4/1989 | Yasui | 350/332 |
| 4,827,255 | 5/1989 | Ishii | 340/793 |
| 4,836,654 | 6/1989 | Fujimura et al. | 350/346 |
| 4,838,655 | 6/1989 | Hunahata et al. | 350/335 |
| 4,842,379 | 6/1989 | Oishi et al. | 350/347 |
| 4,843,381 | 6/1989 | Baron | 340/784 |
| 4,855,724 | 8/1989 | Yang | 340/703 |
| 4,864,290 | 9/1989 | Waters | 340/793 |
| 4,864,538 | 9/1989 | Buzak | 365/128 |
| 4,870,396 | 9/1989 | Shields | 340/719 |
| 4,886,343 | 12/1989 | Johnson | 350/335 |
| 4,917,465 | 4/1990 | Conner et al. | 350/335 |
| 4,921,334 | 5/1990 | Akodes | 350/333 |
| 4,922,241 | 5/1990 | Inoue et al. | 340/784 |
| 4,936,656 | 6/1990 | Yamashita et al. | 350/333 |
| 4,946,260 | 8/1990 | Fujumura et al. | 350/346 |
| 4,950,058 | 8/1990 | Diem et al. | 350/333 |
| 4,952,032 | 8/1990 | Inoue et al. | 350/350 |
| 4,962,376 | 10/1990 | Inoue et al. | 340/784 |
| 4,964,699 | 10/1990 | Inoue | 350/332 |
| 4,980,775 | 12/1990 | Brody | 358/241 |
| 4,982,180 | 1/1991 | Seki et al. | 340/703 |
| 4,989,076 | 1/1991 | Owada et al. | 358/61 |
| 4,991,122 | 2/1991 | Sanders | 364/521 |
| 4,999,619 | 3/1991 | Te Velde | 340/784 |
| 5,010,326 | 4/1991 | Yamazaki et al. | 340/784 |
| 5,012,228 | 4/1991 | Masuda et al. | 340/702 |
| 5,032,007 | 7/1991 | Silverstein et al. | 350/335 |
| 5,039,983 | 8/1991 | Yoon | 340/703 |
| 5,041,821 | 8/1991 | Onitsuka et al. | 345/101 |
| 5,068,649 | 11/1991 | Garrett | 340/793 |
| 5,077,533 | 12/1991 | Buzak | 340/794 |
| 5,092,665 | 3/1992 | Kanbe et al. | 359/56 |
| 5,093,652 | 3/1992 | Bull et al. | 340/701 |
| 5,101,197 | 3/1992 | Hix et al. | 340/784 |
| 5,105,183 | 4/1992 | Beckman | 340/717 |
| 5,105,265 | 4/1992 | Sato et al. | 358/60 |
| 5,107,353 | 4/1992 | Okumura | 359/55 |
| 5,115,305 | 5/1992 | Baur et al. | 358/60 |
| 5,117,224 | 5/1992 | Kawamura et al. | 340/703 |
| 5,119,084 | 6/1992 | Kawamura et al. | 340/784 |
| 5,122,783 | 6/1992 | Bassetti, Jr. | 340/701 |
| 5,124,818 | 6/1992 | Conner et al. | 359/53 |
| 5,126,865 | 6/1992 | Sarma | 359/59 |
| 5,128,782 | 7/1992 | Wood | 309/48 |
| 5,132,826 | 7/1992 | Johnson et al. | 359/93 |
| 5,172,108 | 12/1992 | Wakabayashi et al. | 340/793 |
| 5,172,222 | 12/1992 | Plantier et al. | 358/61 |
| 5,175,535 | 12/1992 | Yamazaki et al. | 340/784 |
| 5,185,602 | 2/1993 | Basetti, Jr. et al. | 340/793 |
| 5,187,603 | 2/1993 | Bos | 359/73 |
| 5,196,834 | 3/1993 | Edelson et al. | 340/703 |
| 5,200,844 | 4/1993 | Suvada | 359/40 |
| 5,202,676 | 4/1993 | Yamazaki | 340/784 |
| 5,204,659 | 4/1993 | Sarma | 340/784 |
| 5,214,417 | 5/1993 | Yamazaki | 340/784 |
| 5,225,823 | 7/1993 | Kanaly | 340/793 |
| 5,227,882 | 7/1993 | Kato | 358/160 |
| 5,227,904 | 7/1993 | Nakanowatari | 359/103 |
| 5,233,338 | 8/1993 | Surguy | 340/784 |
| 5,233,446 | 8/1993 | Inoue et al. | 359/55 |
| 5,237,435 | 8/1993 | Kurematsu et al. | 359/41 |
| 5,245,450 | 9/1993 | Ukai et al. | 359/55 |
| 5,245,455 | 9/1993 | Sayyah et al. | 359/72 |
| 5,251,049 | 10/1993 | Sato et al. | 359/40 |
| 5,252,959 | 10/1993 | Kono | 345/147 |
| 5,264,835 | 11/1993 | Shaw et al. | 345/150 |
| 5,289,173 | 2/1994 | Numao | 345/87 |
| 5,293,534 | 3/1994 | Mihara | 359/84 |
| 5,296,953 | 3/1994 | Kanbe et al. | 359/56 |
| 5,299,039 | 3/1994 | Bohannon | 359/53 |
| 5,300,945 | 4/1994 | Iemoto et al. | 345/92 |
| 5,313,224 | 5/1994 | Singhal et al. | 345/89 |
| 5,327,229 | 7/1994 | Konno et al. | 348/742 |
| 5,337,068 | 8/1994 | Stewart et al. | 345/88 |
| 5,341,153 | 8/1994 | Benzschawel et al. | 345/152 |
| 5,347,382 | 9/1994 | Rumbaugh | 359/84 |
| 5,359,345 | 10/1994 | Hunter | 345/102 |
| 5,363,117 | 11/1994 | Matsuura et al. | 345/87 |
| 5,365,274 | 11/1994 | Seki et al. | 348/458 |
| 5,381,182 | 1/1995 | Miller et al. | 348/448 |
| 5,386,237 | 1/1995 | Knee | 348/458 |
| 5,396,261 | 3/1995 | Hastings, III | 345/92 |
| 5,410,422 | 4/1995 | Bos | 359/73 |
| 5,412,396 | 5/1995 | Nelson | 345/89 |
| 5,414,443 | 5/1995 | Kanatani et al. | 345/95 |
| 5,418,572 | 5/1995 | Nonweiler et al. | 348/446 |
| 5,424,780 | 6/1995 | Cooper | 348/428 |
| 5,426,526 | 6/1995 | Yamamoto et al. | 359/82 |
| 5,428,366 | 6/1995 | Eichenlaub | 345/102 |
| 5,430,460 | 7/1995 | Takabatake et al. | 345/96 |
| 5,444,494 | 8/1995 | Yamamoto et al. | 348/448 |
| 5,455,628 | 10/1995 | Bishop | 348/446 |
| 5,457,551 | 10/1995 | Culter et al. | 359/53 |
| 5,459,495 | 10/1995 | Scheffer et al. | 345/147 |
| 5,467,138 | 11/1995 | Gove | 348/452 |
| 5,471,249 | 11/1995 | Monta et al. | 348/445 |
| 5,473,339 | 12/1995 | Kanatani et al. | 345/87 |
| 5,479,188 | 12/1995 | Moriyama | 345/149 |

| | | | |
|---|---|---|---|
| 5,488,387 | 1/1996 | Maeda et al. | 345/89 |
| 5,488,389 | 1/1996 | Nakanishi et al. | 345/131 |
| 5,488,499 | 1/1996 | Tanaka et al. | 359/102 |
| 5,493,428 | 2/1996 | Kim | 359/54 |
| 5,495,265 | 2/1996 | Hartman et al. | 345/87 |
| 5,495,287 | 2/1996 | Kasai et al. | 345/89 |
| 5,499,036 | 3/1996 | Hauck | 345/3 |
| 5,499,037 | 3/1996 | Nakagawa et al. | 345/89 |
| 5,519,824 | 5/1996 | Lizzi | 395/150 |
| 5,521,727 | 5/1996 | Inaba et al. | 359/56 |
| 5,526,063 | 6/1996 | Joubert et al. | 348/744 |
| 5,528,262 | 6/1996 | McDowell et al. | 345/151 |
| 5,534,884 | 7/1996 | Mase et al. | 345/87 |
| 5,534,926 | 7/1996 | Ohki et al. | 348/385 |
| 5,534,936 | 7/1996 | Kim | 348/448 |
| 5,537,128 | 7/1996 | Keene et al. | 345/89 |
| 5,537,129 | 7/1996 | Okada et al. | 345/90 |
| 5,546,102 | 8/1996 | Scheffer et al. | 345/100 |
| 5,550,662 | 8/1996 | Bos | 359/73 |
| 5,552,801 | 9/1996 | Furuhashi et al. | 345/100 |
| 5,552,840 | 9/1996 | Ishii et al. | 348/751 |
| 5,555,035 | 9/1996 | Mead et al. | 348/757 |
| 5,561,442 | 10/1996 | Okada et al. | 345/94 |
| 5,566,010 | 10/1996 | Ishii et al. | 359/59 |
| 5,572,655 | 11/1996 | Tuljapurkar et al. | 395/788 |
| 5,579,027 | 11/1996 | Sakurai et al. | 345/100 |
| 5,581,383 | 12/1996 | Reichel et al. | 349/116 |
| 5,583,528 | 12/1996 | Ebihara | 345/58 |
| 5,583,534 | 12/1996 | Katakura et al. | 345/97 |
| 5,583,678 | 12/1996 | Nishino et al. | 349/118 |
| 5,594,464 | 1/1997 | Tanaka et al. | 345/94 |
| 5,598,285 | 1/1997 | Kondo et al. | 349/39 |
| 5,627,557 | 5/1997 | Yamaguchi et al. | 345/90 |
| 5,640,259 | 6/1997 | Sawayama et al. | 349/33 |
| 5,642,129 | 6/1997 | Zaukacky et al. | 345/100 |
| 5,721,597 | 2/1998 | Kakinuma et al. | 349/86 |
| 5,828,357 | 10/1998 | Tamai et al. | 345/210 |

FOREIGN PATENT DOCUMENTS

| | | |
|---|---|---|
| 0437238 | 7/1991 | European Pat. Off. . |
| 0622655 | 11/1994 | European Pat. Off. . |
| 0632426 | 4/1995 | European Pat. Off. . |
| 0660297 | 6/1995 | European Pat. Off. . |
| 0 825583A2 | 2/1998 | European Pat. Off. . |
| 0 827 130A2 | 3/1998 | European Pat. Off. . |
| 5651352 | 12/1981 | Japan . |
| 8220502 | 8/1996 | Japan . |
| 9101497 | 4/1997 | Japan . |
| 9-265073 | 10/1997 | Japan . |
| 8701468 | 3/1987 | WIPO . |
| 9103003 | 3/1991 | WIPO . |
| 9501701 | 1/1995 | WIPO . |
| 9534986 | 12/1995 | WIPO . |
| 9600479 | 1/1996 | WIPO . |

OTHER PUBLICATIONS

SID International Symposium, Digest of Technical Papers, vol. XVII, 1987, pp. 75–78.

Conference Record of 1980 Biennial Display Research Conference, 1980, pp. 177–179.

Wu, S., "Nematic Liquid Crystal Modulator with Response Time Less Than 100 $\mu$s At Room Temperature", Appl. Phys. Lett. 57 No. 10, Sep. 3, 1990, pp. 986–988.

Wu. S. et al., "High Speed Nematic Liquid Crystal Modulators", 3rd International Topical Meeting on Optis of LCs, Oct. 1–5, 1990, Italy, pp. 1–15.

Clark, N. et al, "Submicrosecond Bistable Electro–Optic Switching In Liquid Crystals", Appl. Phys. Lett. vol. 36, No. 11, Jun. 1, 1980, pp. 899–901.

Sayyah, K. et al., "Late–News Poster Color–Sequential Crystalline–Silicon LCLV–Based Projector for Consumer HDTV", Hughes Research Laboratories, Malibu, CA, SID 95' Digest, 1995, pp. 520–523.

Okada, H. et al., "An 8.4–in. TFT–LCD System for a Note–Size Computer Using 3–Bit Digital Data Drivers", Japan Display 1992, pp. 475–478.

Fujisawa, T. et al., "Electro–Optic Properties and Multiplexibility for Polymer Network Liquid Crystal Display (PN–LCD)", Japan Display, vol. 690 (1989), pp. 690–693.

PCT International Search Report (PCT/US 97/23963) mailed May 18, 1998.

PCT International Search Report (PCT/US 97/22000) mailed May 18, 1998.

PCT International Search Report (PCT/US 97/21919) mailed May 7, 1998.

PCT International Search Report (PCT/US 97/21991) mailed May 7, 1998.

Electro-optic Curve for Normally White Liquid Crystal

DISPLAY SYSTEM HAVING ELECTRODE MODULATION TO ALTER A STATE OF AN ELECTRO-OPTIC LAYER

The present application is a continuation-in-part of co-pending U.S. patent application Ser. No. 08/801,994, which was filed on Feb. 18, 1997, which is a continuation-in-part (CIP) of U.S. patent application Ser. No. 08/770,233, which was filed on Dec. 19, 1996 now U.S. Pat. No. 5,920,298 by the same inventor under the title "Display System Having Common Electrode Modulation." This application is also a CIP of U.S. patent application Ser. Nos. 08/920,602 and 08/920,603, both of which were filed on Aug. 27, 1997. This application is also a CIP of co-pending U.S. Provisional Patent Application No. 60/065,087, which was filed on Nov. 11, 1997; this application claims the benefit of the provisional's filing date under 35 U.S.C. §119(e). This present application hereby claims the benefit of these earlier filing dates under 35 U.S.C. §120.

BACKGROUND OF THE INVENTION

1. Field of the Invention

The present invention relates generally to a display system, such as a liquid crystal display system. The present invention also relates to a system for providing electrical driving of an electrode of a display system. More particularly, the invention relates to a system for electrically driving an electrode of a display system to various voltages in a controlled phase relationship to the update of pixel data.

2. Background of the Related Art

A class of display systems operate by electrically addressing a thin, intervening layer of electro-optic material, such as liquid crystal, which is positioned between two substrates. In these display systems, it is important to achieve good display characteristics including: color purity, high contrast, high brightness, and a fast response.

High independence of frames or subframes ensures the lack of coupling between intensity values at a given pixel from one frame to the next. For example, if a pixel is to be at its brightest gray level during a first frame and then at its darkest gray level at the second frame, then a high independence would ensure that this is possible whereas a low independence would cause the pixel to appear brighter than the darkest gray level during the second frame. This coupling can cause problems such as motion smearing. High frame-to-frame independence is important whether or not the display is a color or black-and-white (monochrome) or gray-scale display.

The level of contrast achievable is determined by the range of intensity attainable between the brightest gray level and the darkest gray level for a given pixel within a given frame or subframe.

In addition to contrast, it is desirable that the display be capable of displaying a bright image since brighter images are perceived as having a higher quality by a user.

Finally, the speed of display is determined by its ability to display one frame after the other at a high rate. If visual motion is to be displayed, flicker and other problems can be avoided only if the full color frames are displayed at a rate of at least 30 Hz and preferably 60 Hz or faster.

This speed requirement becomes even more stringent if the display pixels are not color triads (in other words, red, green and blue subpixels for each pixel location) but instead only has a single pixel. One type of such a display is a color sequential liquid crystal display as discussed in "Color-Sequential Crystalline-Silicon LCLV based Projector for Consumer HDTV" by Sayyah, Forber, and Efrom in SID digest (1995) pages 520–523. In those types of displays, if a display requires the sequential display of the red, green, and blue subframes, those subframes must be displayed at yet a rate higher than 90 HZ and preferable greater than 180 HZ to avoid flicker. For color sequential displays, high frame or subframe independence is required to display images with good color purity.

Any of the active matrix display systems that operate by electrically addressing a thin, intervening layer of electro-optic material, such as liquid crystal, which is positioned between two substrates include the following characteristics. At least one of the two substrates is transparent or translucent to light and one of the substrates includes a plurality of pixel electrodes. Each pixel electrode corresponds to one pixel (or one subpixel) of the display, and each of the former may be driven independently to certain voltages so as to control the intervening electro-optic layer in such a way as to cause an image to be displayed on the electro-optic layer of the display. Sometimes each pixel can include a color triad of pixel electrodes. The second substrate of such a prior art display system has a single electrode, known as the common electrode or cover glass electrode, which serves to provide a reference voltage so that the pixel electrodes can develop an electric field across the intervening layer of electro-optic material.

One example of such a system is a color thin film transistor (TFT) liquid crystal display. These displays are used in many notebook-sized portable computers. Colors are generated in these displays by using RGB pixel triads in which each pixel of the triad controls the amount of light passing through its corresponding red, green, or blue color filter. These color filters are one of the most costly components of a TFT display.

The major obstacle of display systems of this type is that the results of replicating the pixel electrodes, data wire, and thin film transistors, three times at each color pixel are increased cost and reduced light transmission, requiring more peripheral backlights and increased power consumption.

The other issues of high frame-to-frame independence, high contrast, and brightness become even more difficult to achieve as display rates increase.

Many approaches have been implemented to improve display characteristics of the above type displays. One common approach involves the use of a common electrode driving circuit and driving that common electrode with as flat a common electrode rectangular driving voltage waveform as possible. By doing so, the voltage across the liquid crystal portion at that pixel is more constant, which in turn should yield improved contrast and pixel brightness.

For example, U.S. Pat. No. 5,537,129 discloses a display system with a common electrode which attempts to achieve a flat rectangular common electrode driving voltage. Referring to FIG. 2 of that patent, a common electrode 24 is connected to its driving circuit 20 through a resistor 3*b*. This corrects for resistive losses at 3*a* and capacitive coupling to the common electrode 24 from pixels and data wires. This ensures that detection device 21 with a high input impedance can be used to make a correction so the output voltage appears to be more rectangular-like. FIGS. 5, 9*b*, 11(c), and 11(d) of that U.S. patent all show the desired rectangular waveforms.

Another example of this is shown with U.S. Pat. No. 5,561,442, which shows that with the properly applied common electrode voltage Vc(t) when coordinated with the previous gate wire voltage Vs(t) and the current gate wire voltage Vg(t), can yield a flat rectangular voltage V(t)-Vc(t) across the liquid crystal ($C_{LC}$). This scheme involves a complicated modulation scheme coordinating modulation voltages at gate wires in relation to the modulation of the voltage at the common electrode in order to achieve their desired flat rectangular modulation of voltage across the liquid crystal.

SUMMARY OF THE INVENTION

The present invention provides various methods and apparatuses for controlling a voltage on an electrode which is used to alter the state of an electro-optic material, such as a liquid crystal layer, such that display data cannot be viewed even if pixel electrodes contain pixel data thereon. This control voltage on the electrode is typically provided in a controlled phase relationship relative to the update of pixel data in order to achieve, at least in some embodiments of the present invention, frame-to-frame independence, even at high rates of display.

A display system in one embodiment of the present invention includes a first substrate having a first plurality of pixel electrodes for receiving a first plurality of pixel data values representing a first image to be displayed and also includes an electro-optic layer which is operatively coupled to the pixel electrodes and an electrode operatively coupled to the electro-optic layer. This display system displays the first image and then applies a first control voltage to the electrode to alter a state of the electro-optic layer such that the first image is substantially not viewable and thus not displayed, and then the display system displays a second image represented by a second plurality of pixel data values after the electrode receives a second control voltage.

Typically, at least in some embodiments of the present invention, the electro-optic layer is a liquid crystal layer and the electrode is a common cover glass electrode. This common cover glass electrode and the first substrate forms a structure around the liquid crystal layer such that the first substrate is below the liquid crystal layer and the common cover glass electrode is above the liquid crystal layer. At least in some embodiments, the first control voltage causes the liquid crystal layer to alter its light altering state to turn the display "dark" even if pixel data on the pixel electrodes are still present and would otherwise cause the display to appear white or some other color other than black. After the display is kept at a state such that the first image is not viewable, then the display system displays a second image by causing the electrode to receive a second control voltage which releases the liquid crystal material from its state in which substantially no display data is viewable.

In an example of one aspect of the present invention, the voltage difference between the first control voltage and the second control voltage is reduced to reduce the capacitive shifting of the second plurality of pixel data values on the plurality of pixel electrodes. In one particular example, the voltage transition from a reset or hold state to a view state of a cover glass electrode is reduced in order to reduce capacitive shifting of the pixel values stored on the pixel electrodes.

In an example of another aspect of the present invention, at least one of the first control voltage, the second control voltage and a pixel data value of the second plurality of pixel data values is determined by an illumination color used in displaying said second pixel data. In one particular example, different view voltages are applied on the cover glass electrode depending on the color that is being displayed in a time sequential color display system, and different hold and/or reset voltages may be applied to the cover glass electrode for different colors in a time sequential color display system.

In an example of another aspect of the present invention, the electrode (such as the cover glass electrode) receives a composite signal over time, and a first parameter of at least one of the first control voltage and the second control voltage is selected to provide an offset, for a portion of the composite signal, from a DC balanced signal over time with respect to a particular voltage. In one particular example, this offset is compensated for by selecting a second parameter of at least one of the first control voltage and the second control voltage such that the composite signal is a DC balanced signal over time with respect to the particular voltage.

There are numerous alternative embodiments of the present invention. For example, the cover glass electrode may exist in separate segments and these segments may be controlled separately such that while one segment is displaying a portion of an image, the other pixels opposed to the segment are being loaded with pixel data for another portion of the same image and at the same time this other portion is not displaying data because its control electrode in that segment is causing the liquid crystal material in that segment to obscure the data such that it is not viewable. The present invention may be used in either time sequential color systems or in color systems which employ a triad of sub-pixels for each pixel. Moreover, the present invention may be employed with or without frame buffering for the next frame while the current frame is being displayed, where this frame buffering may be provided in pixel buffers which are disposed in the same substrate which includes the pixel electrodes. Moreover, the present invention may be used in liquid crystal display devices which are of the reflective type, or alternatively may be used in liquid crystal display devices which are of the transmissive type. Furthermore, the electrode modulation of the present invention may be employed in a system wherein the electrode which performs the modulation (in order to drive the liquid crystal to a state in which display data is not substantially viewable) is disposed in the same substrate as the pixel electrodes. The present invention in certain embodiments may also include compensating electrodes disposed in the same substrate with the pixel electrodes which compensate for the action of the control electrodes which are causing the display to be not viewable according to certain embodiments of the present invention. In some embodiments, pulse illumination rather than continuous illumination may be used. In certain embodiments, a control device which is coupled to at least one pixel electrode applies a first reference voltage to the at least one pixel electrode before the display system displays the second image. Typically, the first reference voltage is applied to the pixel electrodes while the first image is substantially not viewable due to the first control voltage on the electrode. The first reference voltage "clamps" the pixel electrodes at a predetermined value, and then the new pixel values are loaded onto the pixel electrodes.

At least some embodiments of the present invention provide various advantages which are described below, although it will be appreciated that certain embodiments of the present invention may only provide some, if any, of these advantages depending on the implementation of the embodiment. For example, the present invention may be used to provide for a display system in which the pixel optical intensity outputs on the display are simultaneously updated with new data even though the pixel electrode voltages are updated on a row-by-row basis when no frame buffering is used. Moreover, the invention may be used to provide a display system in which there is high frame-to-frame independence, even at high frame rate frequencies. Another advantage of the present invention, at least in some embodiments, is that by simultaneously varying the voltage which drives the control electrode and the voltages which drive the pixel electrodes, fill use can be made of the voltage range available at the pixel electrodes, thereby improving brightness. In another embodiment of the present invention, a voltage greater that the maximum and minimum voltages allowed for driving the pixel electrodes can be used as the control voltage signal applied to the control electrode. This advantage may be useful in a situation where the liquid crystal electro-optic effect has a threshold below which no optical effect occurs. Another advantage of the present invention in certain embodiments is that if the control electrode voltage is modulated with a burst of relatively high frequency oscillation, a dual-frequency liquid crystal display can be driven rapidly.

BRIEF DESCRIPTION OF THE DRAWINGS

The various embodiments of the present invention will be described in detail with reference to the following drawings in which like reference numerals refer to like elements.

FIG. 8 also shows the intensity of certain pixels over time relative to the waveforms shown in FIG. 8.

DETAILED DESCRIPTION

The following description provides examples of the present invention. It will be appreciated, however, that other examples of the present invention will become apparent to those in the art upon examination of this description. Thus, the present description and the accompanying drawings are for purposes of illustration and are not to be used to construe the invention in a restrictive manner.

Figure 1A:
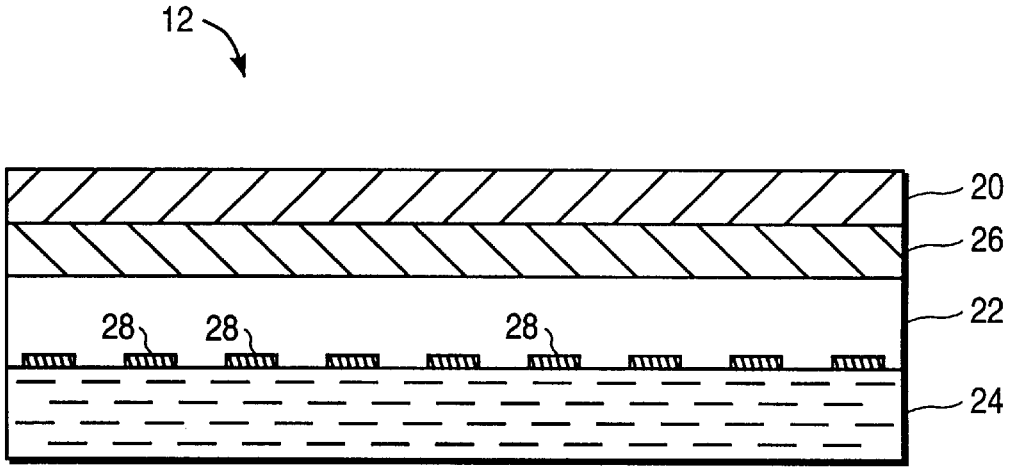
FIG. 1A shows a cross-sectional view and FIG. 1B shows a perspective view of an image display system according to one embodiment of the invention.
Figure 1B:
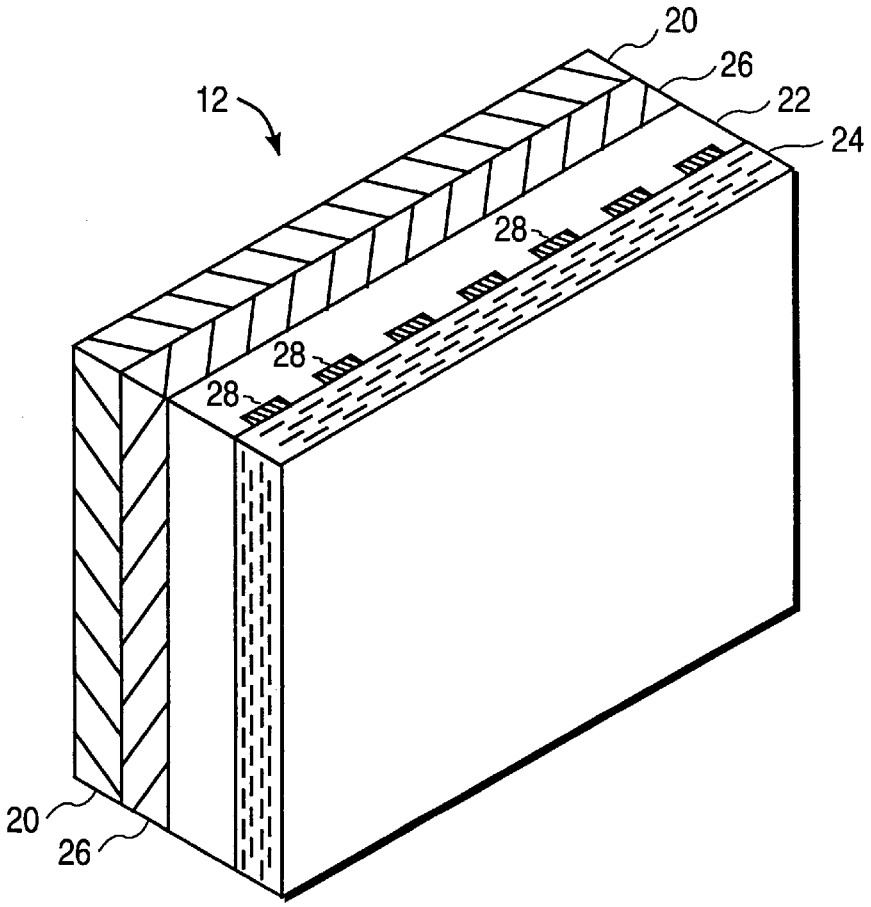

FIG. 1A shows a cross-sectional view of a display system 12 according to one embodiment of the present invention, in which an electro-optic layer 22 is disposed between a first substrate 20 and a second substrate 24. First substrate 20 has a single control electrode known as a common electrode 26 or a cover glass electrode 26. The second substrate has a plurality of pixel electrodes 28 each of which periodically acquires updated image data in an independent manner. Each pixel electrode 28 retains the image data required for a given period of time or duration, after which the acquired image data is replaced with new image data. A voltage applied to each pixel electrode relative to a voltage on the common electrode 26 will cause a voltage to appear across the liquid crystal material (VLC) which will then control the light altering properties of the liquid crystal such that the liquid crystal may be selectively placed in at least two light altering states. Typically these states include either allowing light to pass through the display system or not allowing the light to pass through the display system. At least one of the first substrate 20 and the second substrate 24 is transparent or translucent to light. According to one embodiment of the invention, the electro-optic layer 22 may comprise liquid crystal material, and the display system 12 may comprise a liquid crystal display. It will be appreciated that other layers may also be present in the structure of the display system 12, such as alignment layers or optical coatings (e.g. anti-reflective coatings)) and that other layers may be used with the display system 12, such as a polarizing layer or layers. FIG. 1B shows a prospective view of the same display system shown in FIG. 1A. The display system 12 may be a thin film transistor (TFT) system which may be an active matrix transmissive type liquid crystal display device or it may be a reflective type liquid crystal display device such as a liquid crystal on silicon substrate device, such as that described in U.S. Pat. No. 5,426,526, which is hereby incorporated herein by reference.

Figure 2A:
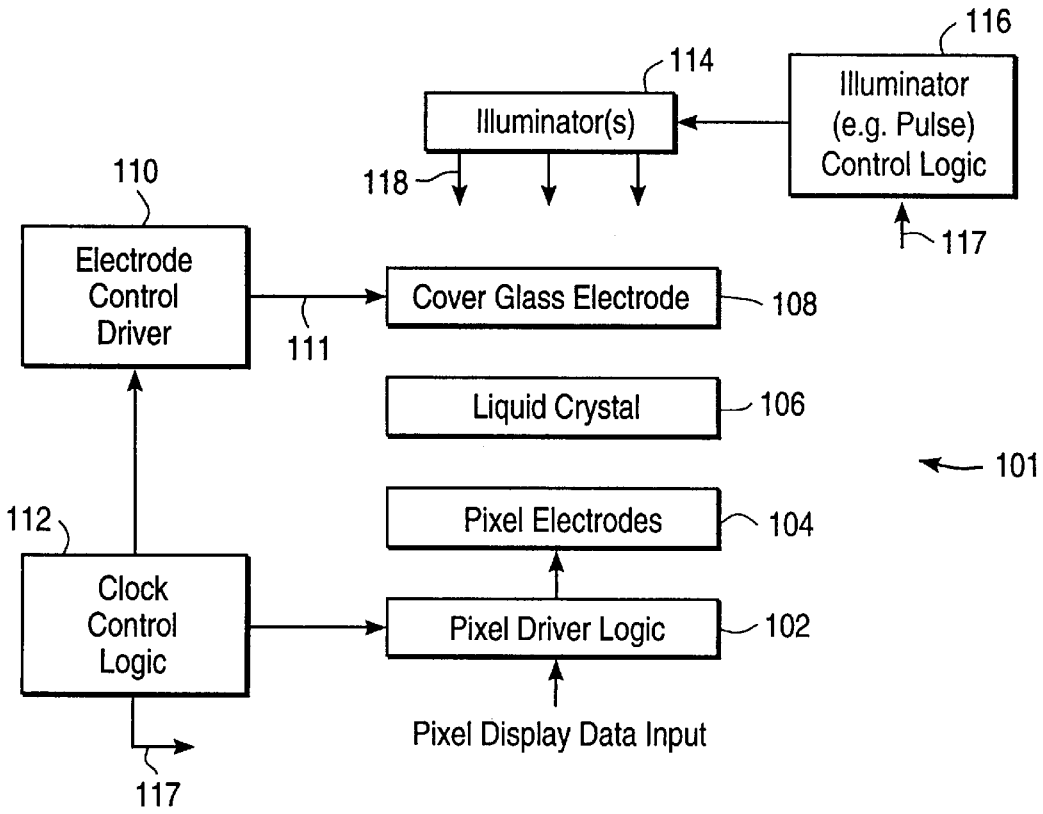
FIG. 2A shows a block diagram representation of a system according to one embodiment of the present invention; this embodiment is a reflective-type liquid crystal display, and it will be appreciated that transmissive-type liquid crystal displays may also be implemented according to the present invention.

FIG. 2A shows a display system 101 according to one embodiment of the present invention. This embodiment employs a reflective type liquid crystal on silicon display system which includes pixel driver logic 102, pixel electrodes 104, a liquid crystal layer 106, and a cover glass electrode 108. The system also includes clock control logic 112, an electrode control driver 110, as well as illuminator 114 and the illuminator control logic 116.

In the system 101, the illuminator 114 may provide white light in the case of a spatial colored display system or it may provide in a controlled time sequence three different color lights (e.g., a red light, and then a green light, and then a blue light each provided separately). The illuminator 114 provides this light 118 through the control of the illuminator control logic 116 which receives clocking signals or control signals 117 from the clock control logic 112. The clock control logic 112 also controls the electrode control driver 110 in order to provide the proper modulated control signal waveforms 111 to the cover glass electrode 108. At the same time, control clock logic 112 also provides clocking signals to the pixel driver logic 102 or it may receive signals from the pixel driver logic 102 in order to coordinate a controlled phase relationship between the control voltage signals applied to the cover glass electrode and the timing of loading and displaying of pixel data onto and through the pixel electrodes 104. The various modes of operation of this system 101 will be described below according to the various embodiments of the present invention.

Figure 2B:
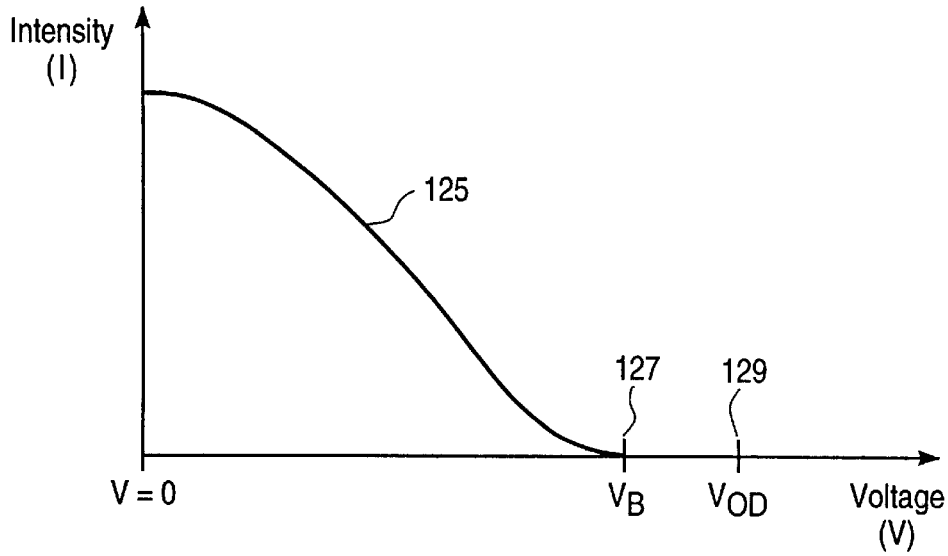
FIG. 2B shows an electro-optic curve for an example of a normally white liquid crystal.

FIG. 2B shows an intensity versus voltage graph displaying an electro-optic curve for a normally white liquid crystal cell configuration. This curve 125 has the highest intensity at the lowest voltage, which may be zero volts. That is, the light altering state of this liquid crystal is such that the most light is transmitted through the liquid crystal at this lowest voltage state. As the voltage across the liquid crystal increases, the intensity of the light transmitted through the liquid crystal decreases to the point where no light is transmitted at voltage point 127 which has been referred to as the holding to black voltage or $V_B$ 127. According to the present invention, an electrode, such as the cover glass electrode, may be applied a voltage relative to the voltages on the various pixel electrodes such that throughout the liquid crystal layer or at least segments thereof, the voltage across the liquid crystal layer is at or exceeds $V_B$. According to certain embodiments of the present invention, the voltage applied to this control electrode may be such that the voltage across the liquid crystal is at point 129, which is an overdrive voltage or $V_{OD}$. This overdrive voltage may be used to rapidly drive the liquid crystal display material to a state in which light does not transmit through it such that the display data is otherwise not viewable even if the display data is stored on the pixel electrodes.

Figure 2C:
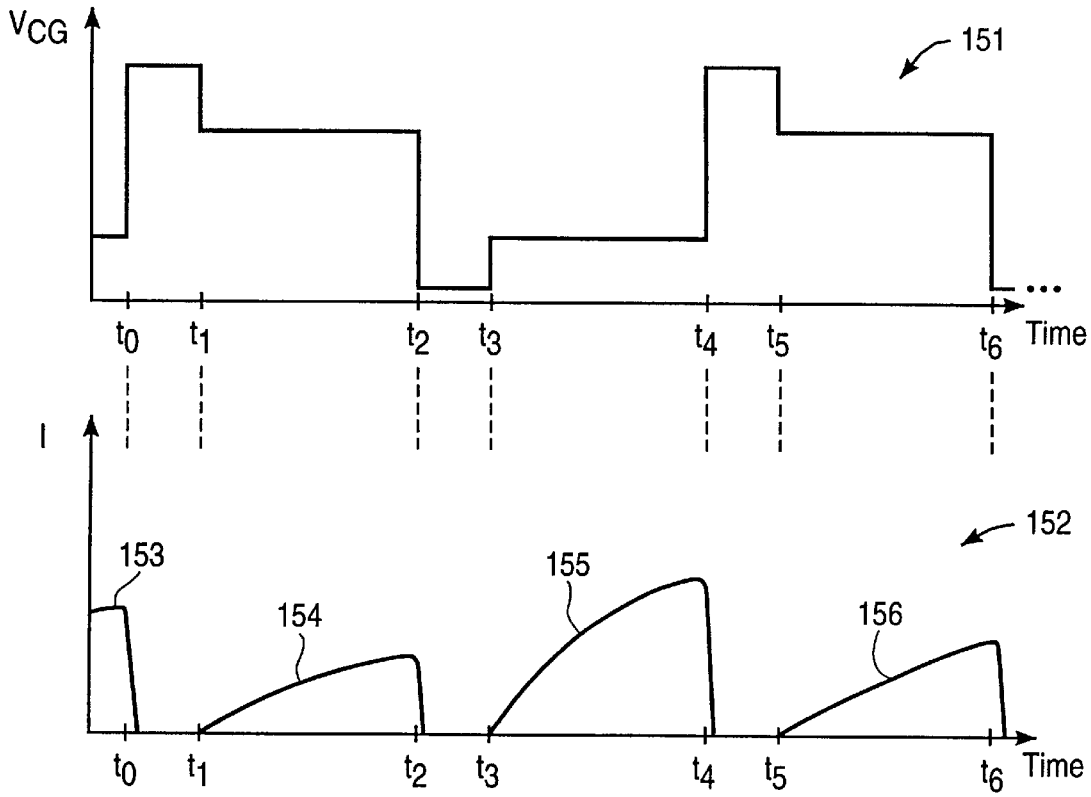
FIG. 2C shows a waveform for a cover glass modulation according to the present invention in conjunction with an intensity versus time graph depicting the behavior of a liquid crystal material under the control of the cover glass waveform also shown in FIG. 2C.

FIG. 2C shows two time related graphs which indicate the relationship between the control voltage applied to the control electrode, such as the cover glass electrode, and the intensity of the pixels in a liquid crystal display of the present invention. The voltage waveform 151 of FIG. 2C shows the control signal applied to the electrode, and the intensity waveforms 152 of FIG. 2C shows the corresponding intensity waveforms at the corresponding times. At time to the voltage applied to the electrode (shown, for example, as $V_{CG}$ in the example where the electrode is the cover glass electrode) is ramped up to a point at which the voltage across the liquid crystal is at least at $V_B$. This causes the intensity of the pixel to drop rapidly as shown by the pixel intensity curve 153. Then between the times $t_0$ and $t_1$ the next pixel display data may be loaded onto the pixel electrode while the display is held in a state in which display data is not visible due to the voltage applied to the control electrode such that the voltage across the liquid crystal ($V_{LC}$) is at or exceeds $V_B$. At time $t_1$ the voltage on the control electrode is reduced, as shown in the voltage waveform 151, such that the voltage across the liquid crystal is less than $V_B$. At this point, it is now possible to display and view the pixel data because the pixel electrodes can now control the state of the liquid crystal. At this point beginning at time $t_1$, the liquid crystal begins to return to a light altering state as shown by the pixel intensity curve 154. Typically, the liquid crystal material will be relaxing to a light altering state which allows more light to pass through. As shown by the pixel intensity curve 154, the liquid crystal may continually relax throughout the entire time period $t_1$ through $t_2$ and may not "plateau" or otherwise reach a steady state. This effect will be discussed further below, but it will be noted that with the present invention this is not necessarily a disadvantage because all such pixels may be substantially simultaneously producing the same effect and yet the viewer can still see the various gradations of color or gray-scale in the image. At time $t_2$, a first control voltage is again applied to the control electrode such as the cover glass electrode to again drive rapidly the liquid crystal material to a state in which the display data is not visible as shown in the waveform 152 between times $t_2$ and $t_3$. At time $t_3$, the voltage on the control electrode is changed from the first control voltage to a second control voltage such that display data may be visible as shown by the pixel intensity curve 155 between times $t_3$ and $t_4$. It will be appreciated that the control voltage waveform 151 which is applied to the control electrode is a DC balanced signal (around some reference level) and that over time it averages to that DC reference level. It will be appreciated that the present invention may be used with DC balanced control signals or without DC balanced control signals, but that there are advantages of using DC balanced control signals.

Figure 2D:
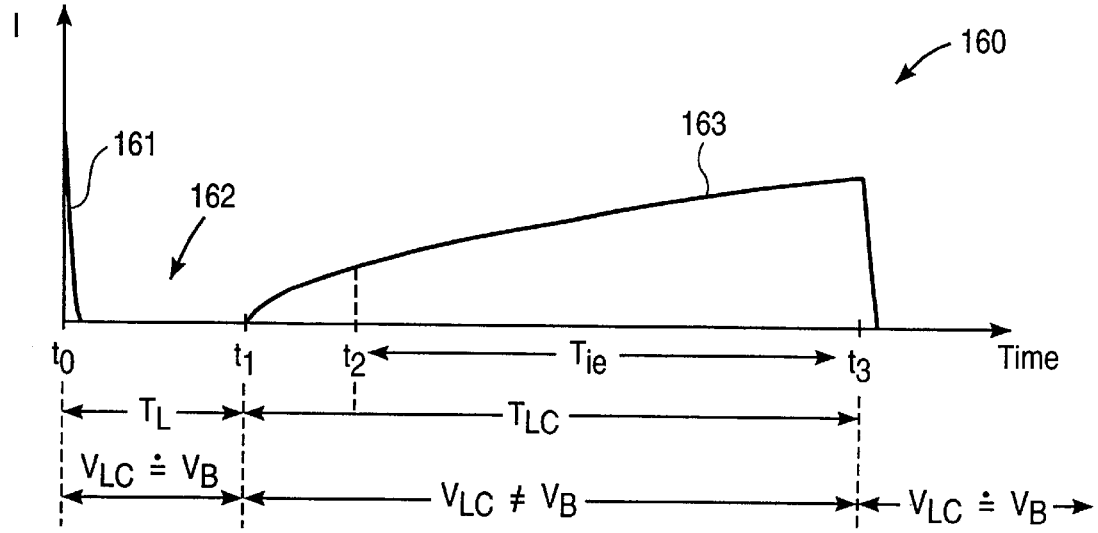
FIG. 2D shows in further detail a portion of the intensity versus time graph for a liquid crystal under the control of a cover glass electrode or other electrode modulated according to the present invention.

FIG. 2D shows in further detail one frame or subframe of a method of the present invention. In particular, a pixel intensity waveform 160 is shown in FIG. 2D as having three portions or curves 161, 162, and 163. Curve 161 illustrates the rapid drive to black of the liquid crystal material upon the application of a control voltage to the control electrode which causes the voltage across the liquid crystal to be approximately equal to $V_B$. During the time in which this control voltage is applied to the control electrode, the pixel intensity is at its lowest as shown by curve 162. It will be appreciated that rather than driving the liquid crystal material entirely to black, the liquid crystal may be driven substantially to a dark state such that the image may be barely discernible. In this alternative embodiment, there still may be substantial benefits derived from driving a liquid crystal state such that the display data is substantially not viewable in order to achieve frame-to-frame independence. During the time between $t_0$ and $t_1$, the next pixel data may be loaded into the pixel electrode as indicated by the time $T_L$. This is also the time during which the display is kept in its dark state by keeping the voltage across the liquid crystal preferably at or above $V_B$. At time $t_1$, the control voltage on the control electrode is released to a second control voltage such that the voltage across the liquid crystal changes, thereby allowing the liquid crystal to relax to various light altering states and allowing display data to be viewable. This is shown by the pixel intensity curve 163 which indicates the intensity of the pixel rising as the liquid crystal continues to relax during the relaxation time designated as TLC which occurs between times $t_1$ and $t_3$. According to various embodiments of the present invention, it may be desirable to provide illumination during the entire time from $t_1$ to $t_3$ or only a portion of the time such as that shown in FIG. 2D. In particular, FIG. 2D shows illumination of the pixel only during the times $t_2$ through $t_3$. In another embodiment, pulses of light during portions of time within the period $t_2$ through $t_3$ may be provided rather than continuously illuminating the display from time $t_2$ through $t_3$. The frame or subframe cycle ends at $t_3$ when the first control voltage is again applied to the control electrode such that the voltage across the liquid crystal is substantially at $V_B$ (or preferably at or above $V_B$).

Figure 3A:
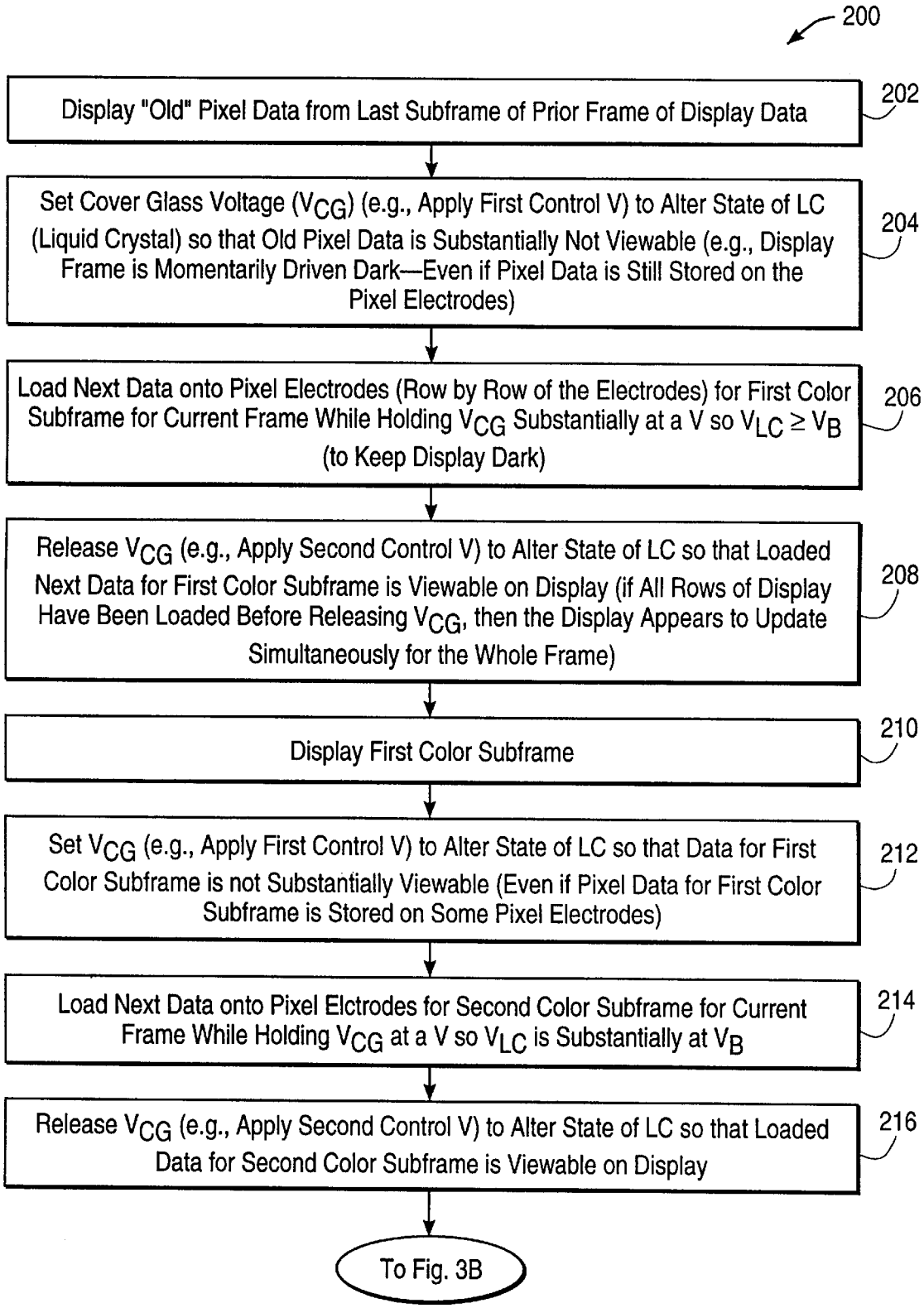
FIGS. 3A and 3B depict a flowchart illustrating a time sequential liquid crystal display system of the present invention without frame buffering of new pixel data while old pixel data is being displayed.
Figure 3B:
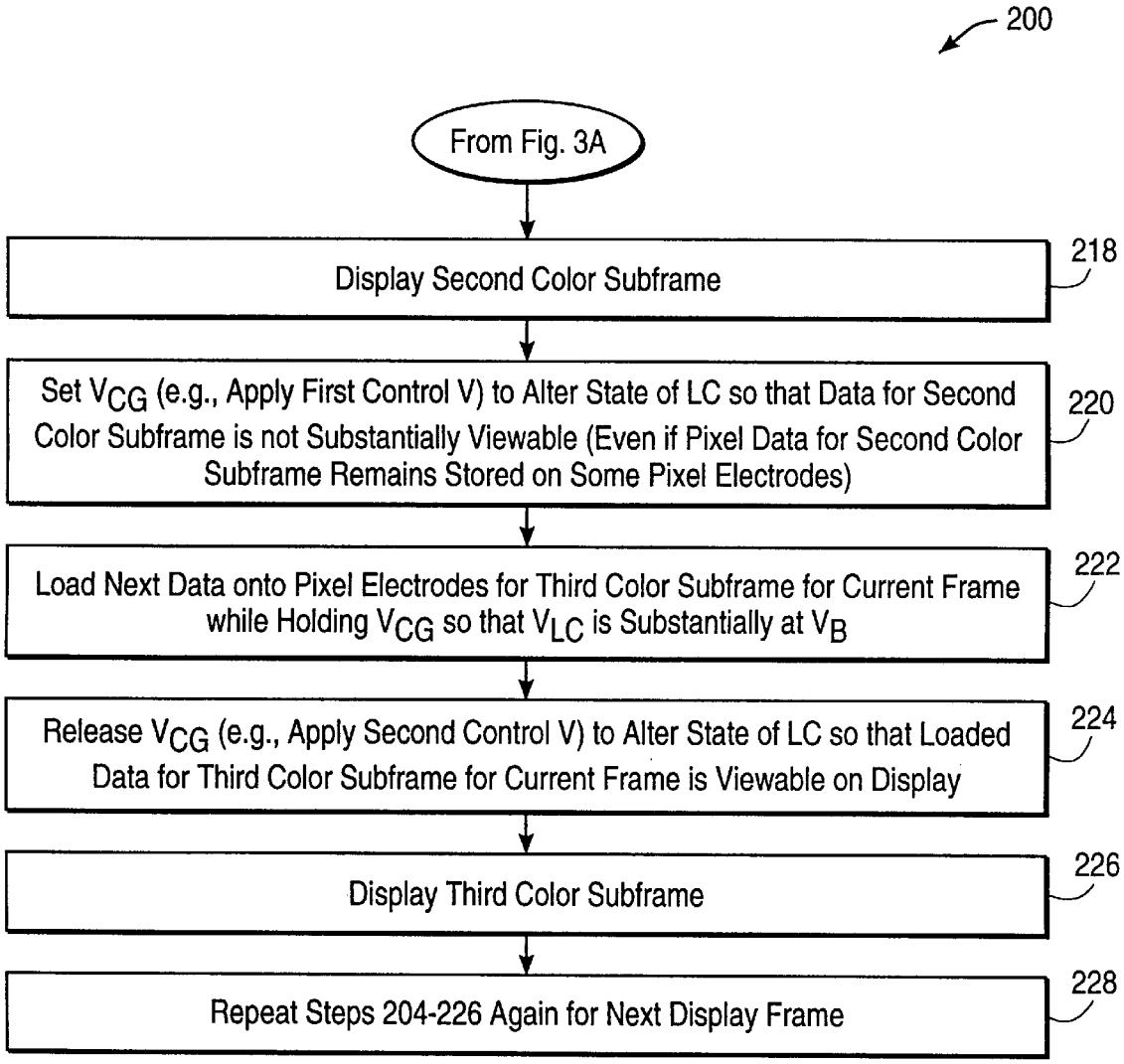
Figure 4A:
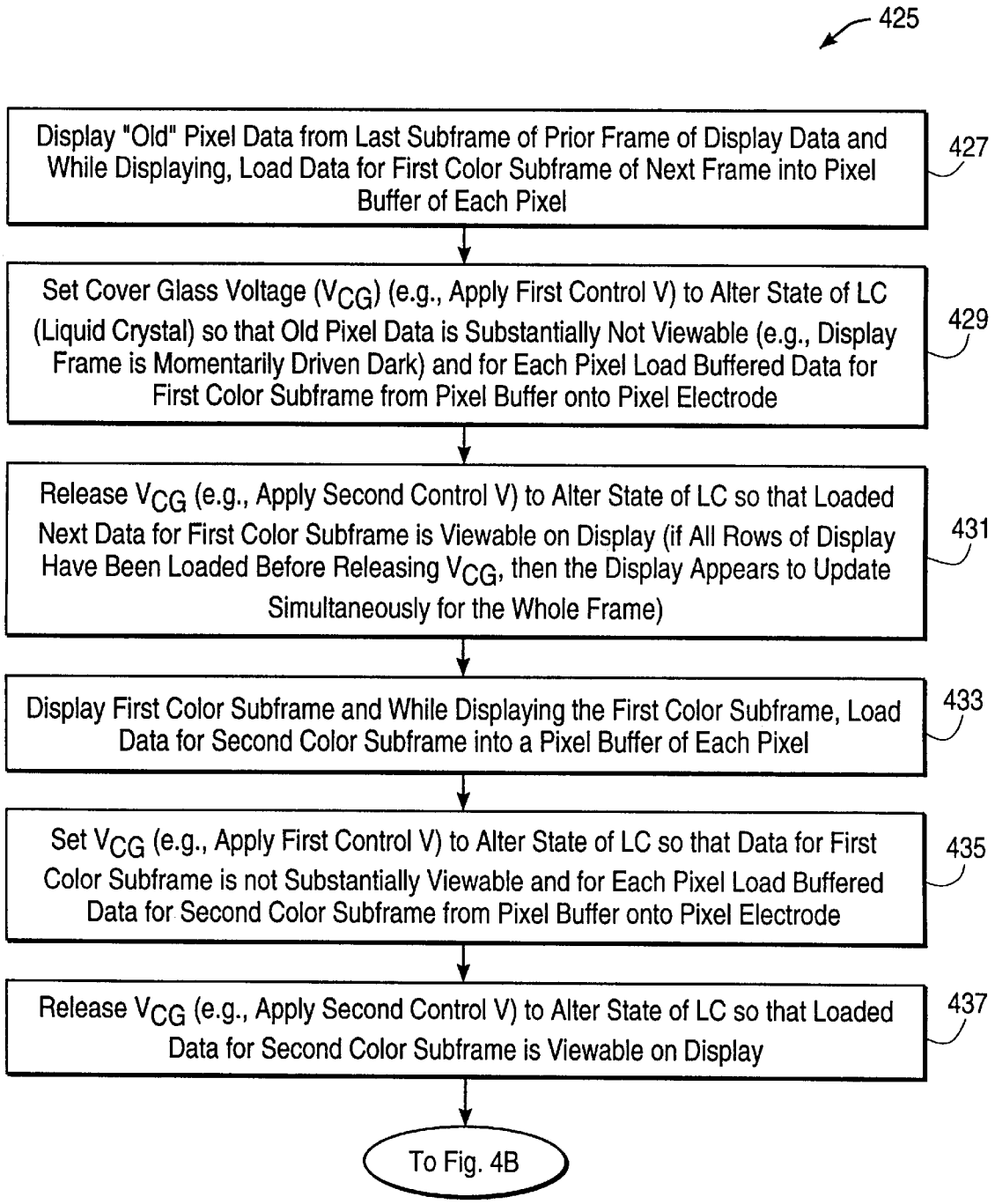
FIGS. 4A and 4B depict a flowchart illustrating an embodiment of the present invention which uses time sequential color subframes with frame buffering.
Figure 4B:
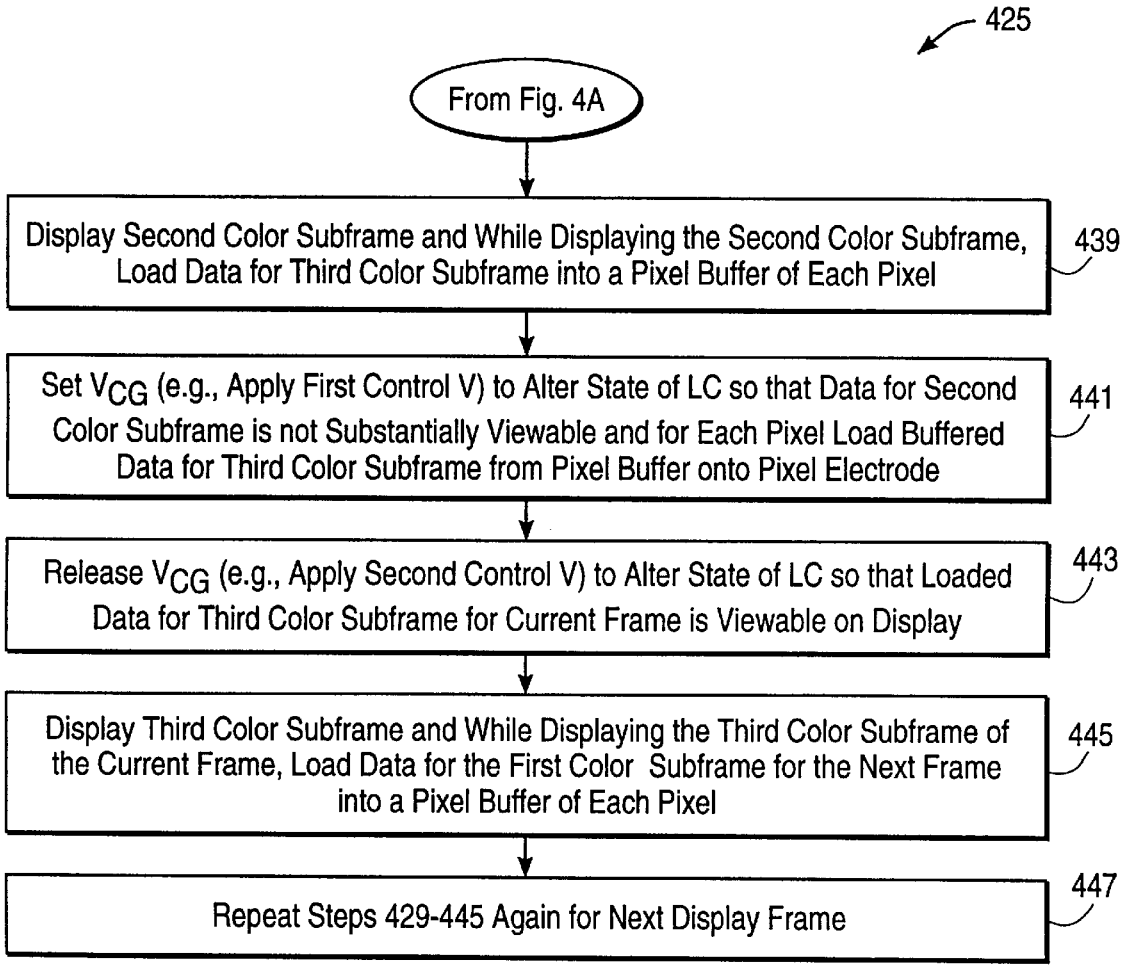

FIGS. 3A and 3B show a particular method of the present invention which is used in a time sequential color display system without any frame buffering in pixel buffers associated with pixel electrodes on the same substrate. FIGS. 4A and 4B show a similar system but with such frame buffering. The method shown in FIGS. 3A and 3B will be described first.

The method 200 may be considered to begin in step 202 in which "old" pixel data may be displayed from the last subframe of the prior frame of display data. Following the end of that display time, in step 204, the cover glass voltage is set by applying a first control voltage to alter the state of the liquid crystal so that the old pixel data is substantially not viewable, even if some of the pixel data is still stored on the pixel electrodes. Typically, the first control voltage applied to the control electrode such as a cover glass electrode is such that relative to the pixel electrode voltages, there will be at least $V_B$ volts across the liquid crystal. In step 206, the next pixel data is loaded onto the pixel electrodes for the first color subframe for the current frame while continuing to hold the voltage of the control electrode substantially at a voltage so that the voltage across the liquid crystal is at least at $V_B$. In this manner, the pixel electrodes are loaded with new data while the display is kept substantially dark. It will be appreciated that typically the data is loaded row by row of the pixel electrodes which correspond to rows on the display, one row at a time. Next, in step 208, the voltage on the control electrode is changed in order to release the state of the liquid crystal so that the loaded next data for the first color subframe (which was loaded in step 206) is now viewable on the display. If all the rows of the display have been loaded before releasing the voltage on the control electrode, then the display appears to update simultaneously for the whole frame. Then in step 210 the first color subframe is displayed for some time. One advantage of the prior sequence of steps is that there is a period of darkness between the old frame and the new frame such that now the frames have more frame-to-frame independence and hence the image appears better to a user. Moreover, even though the pixel data was loaded row by row onto the electrodes rather than simultaneously onto the electrodes for one frame, the display will still appear to update simultaneously for the whole frame because the releasing of the voltage on the control electrode at one time causes the liquid crystal to suddenly be able to change its "pixel" states for the whole liquid crystal layer simultaneously for the whole frame. The simultaneous nature of the liquid crystal's response provides a major advantage because it means that the liquid crystal does not have to complete switching (from a prior light altering state to a new light altering state) before it can be illuminated. Thus, the display system can be illuminated before the liquid crystal finishes switching (or reaching a steady state) and yet the display will still appear uniform across the display. Further, the display system may illuminate the liquid crystal only during a portion of the trajectories, such as only near the end of the trajectories. Another advantage of this invention is that, because the liquid crystal is not, at least in some embodiments, required to complete its switching to a saturated state, the appearance of the display becomes less sensitive to variations in the thickness of the liquid crystal. This improves the apparent uniformity of the display. The fact that the liquid crystal is switched from an unsaturated state of the liquid crystal at the end of a display cycle (shown for example by pixel intensity curve 154 in FIG. 2C) means that display frame rates may be increased (e.g. increasing the frame rate from 30 Hz to 60 Hz) which improves the appearance of the display.

Next in step 212 the voltage on the control electrode is again set (e.g. by applying the first control voltage) to alter the state of the liquid crystal so the data for the first color subframe is substantially not viewable (even if pixel data for the first color subframe is stored on some pixel electrodes). Next in step 214, the next pixel data is loaded onto the pixel electrodes for the second color subframe for the current frame while maintaining the voltage on the control electrode so that the voltage across the liquid crystal is substantially or approximately at $V_B$. In step 216, the second control voltage is applied to the control electrode to allow the liquid crystal to relax so that the loaded data for the second color subframe is viewable on the display. Then in step 218 the second color subframe is displayed for some time. Typically this will include illuminating the display either with continuous illumination or with pulses of illumination as described herein. In step 220 the liquid crystal is again driven to a state in which the pixel data is not viewable. In this case, the data for the second color subframe is made to be substantially not viewable, even if the pixel data for the second color subframe remains stored on some of the pixel electrodes. Then in step 222, the next data is loaded onto the pixel electrodes for the third color subframe for the current frame while holding the voltage on the control electrode so that the voltage across the liquid crystal is substantially at $V_B$. Then at step 224, the voltage on the control electrode is released (e.g. applying a second control voltage) to alter the state of the liquid crystal so that the loaded data for the third color subframe for the current frame is now viewable on the display. Then in step 226, the third color subframe is displayed while illuminating the display system. It will also be appreciated that a similar illumination step may occur in step 210. In step 228, the method repeats steps 204–226 (inclusive) again for the next display frame. This continues for each frame as data is supplied to the system.

Figure 6A:
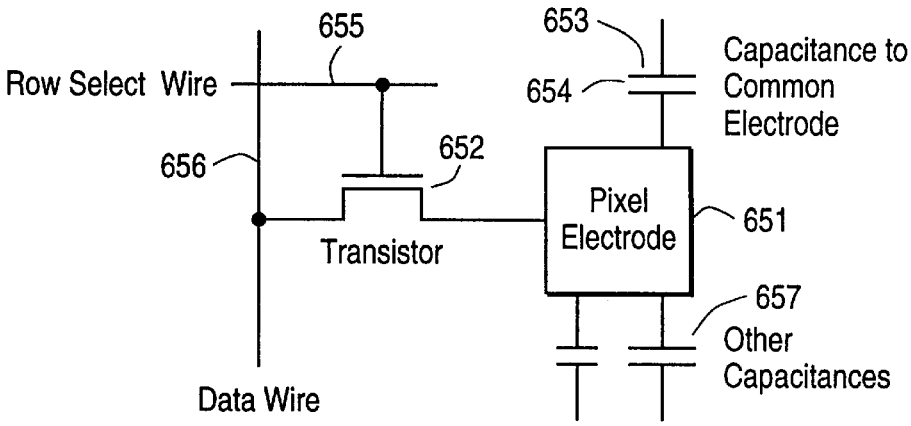
FIG. 6A illustrates an embodiment of a pixel circuit which may be used with the present invention.
Figure 6B:
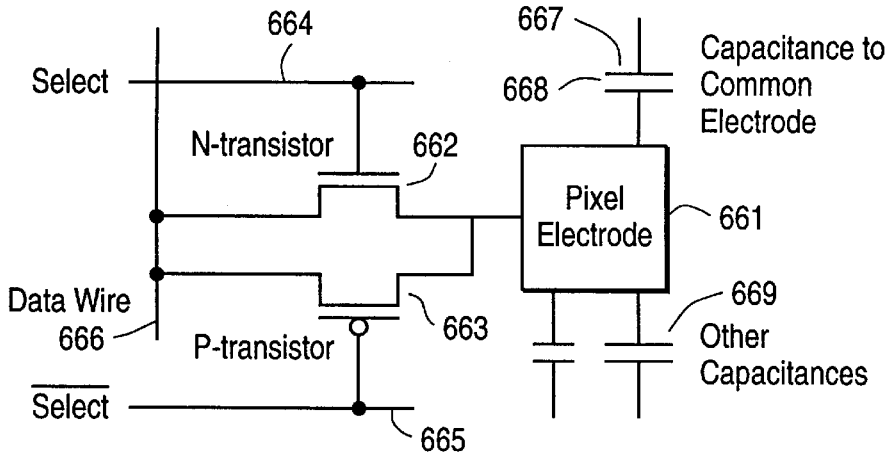
FIG. 6B illustrates an embodiment of a pixel circuit which may also be used with embodiments of the present invention.
Figure 6C:
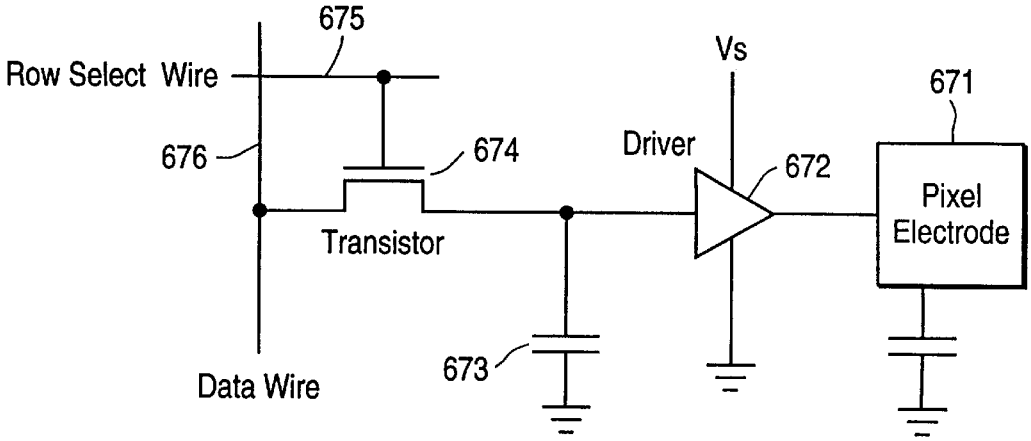
FIG. 6C shows yet another embodiment of a pixel circuit which may be used with embodiments of the present invention.
Figure 6D:
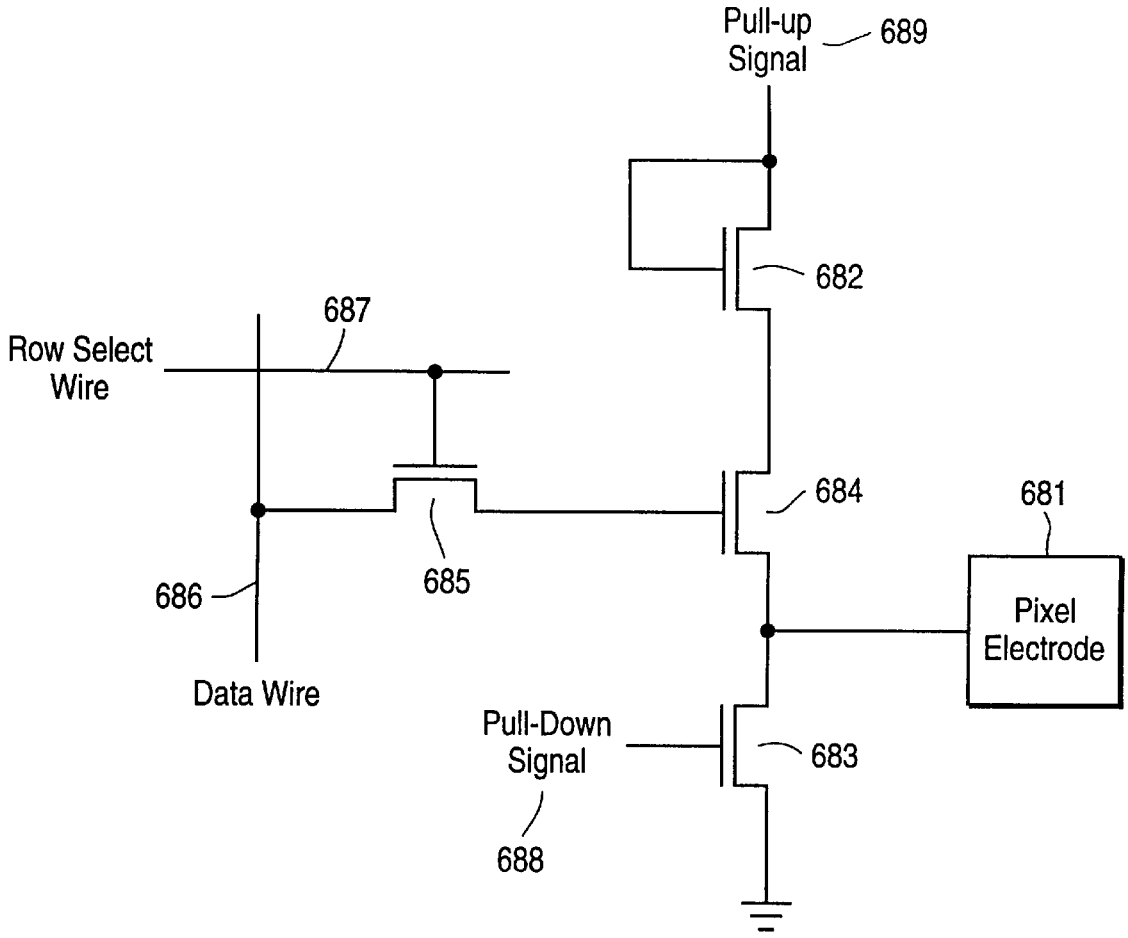
FIG. 6D illustrates a pixel circuit having a pixel buffer which is capable of storing the new pixel data value while the old pixel data value is being displayed; the circuit is capable of storing an analog value in the pixel buffer, and it will be appreciated that a plurality of these pixel circuits arranged in an array provides an analog frame buffer.

The method 425 shown in FIGS. 4A and 4B is similar to the method 200 except that the system of this embodiment uses a pixel frame buffer to store the next frame of pixel data while displaying the current pixel data. That is, while the display step occurs, the pixel buffers which will store the next pixel data are being loaded during the displaying of the current frame. Typically, this may be implemented in a system where the pixel buffer for a particular pixel electrode is located substantially under the pixel mirror electrode. This is described in further detail in U.S. Pat. No. 5,426,526. A particular pixel circuit for performing the pixel-by-pixel frame buffering in a pixel buffer associated with its respective pixel electrode is shown in FIG. 6D herein.

The method 425 begins at step 427 in which old pixel data from the last subframe of the prior frame of display data is displayed; while displaying this old pixel data, data for the first color subframe of the next frame is loaded into a pixel buffer for each pixel. According to one embodiment of the present invention, the pixel buffer stores analog pixel information, and the circuit of FIG. 6D may be employed for this purpose. In step 429, the control electrode, such as the cover glass electrode, is set at a voltage (e.g. by applying a first control voltage) to alter the state of the liquid crystal so that the old pixel data (for the last subframe of the prior frame) is substantially not viewable. Also during this step 429, for each pixel, buffered data stored in each pixel buffer for the first color subframe is loaded from the pixel buffer onto the pixel electrode. In step 431, the voltage on the control electrode is altered so that the state of the liquid crystal may relax thereby allowing the loaded pixel data for the first color subframe to be viewable on the display. If all the rows of the display have been loaded before releasing the control electrode by applying the second control voltage, then the display appears to update substantially simultaneously for the whole frame. Typically, with a frame buffer capability of the system described herein one would normally load all rows of the display although this is not necessarily required for certain embodiments of the invention. In step 433, the first color subframe is displayed and while displaying the first color subframe, data for the second color subframe is loaded into a pixel buffer for each pixel. In step 435, the control electrode, such as the cover glass electrode, receives the first control voltage which alters the state of the liquid crystal so that data for the first color subframe is substantially not viewable; also during this step 435, buffered data for the second color subframe which has been loaded into the pixel buffers is now loaded from the pixel buffer onto the pixel electrode. In step 437, the voltage on the control electrode is changed to "release" the liquid crystal from the state in which it was held in step 435 so that the loaded data for the second color subframe is viewable on the display. In step 439, the second color subframe is displayed and while displaying the second color subframe, data for the third color subframe is loaded into a pixel buffer for each pixel. In step 441, a first control voltage is applied to the control electrode, such as the cover glass electrode, in order to alter the state of the liquid crystal so that data for the second color subframe is substantially not viewable; also during this step 441, pixel data for the third color subframe is loaded from the pixel buffer of each pixel onto the corresponding pixel electrode of each pixel. In step 443, the voltage on the control electrode is changed (e.g. by applying the second control voltage) to alter the state of the liquid crystal so that the loaded data for the third color subframe for the current frame is viewable on the display. Then in step 445, the third color subframe is displayed, and while displaying the third color subframe of the current frame, data for the first color subframe for the next frame is loaded into a pixel buffer of each pixel. In step 447, the method repeats steps 429–445 (inclusive) for the next display frame and this continues for each display frame which is received by the display system of the present invention.

Figure 5:
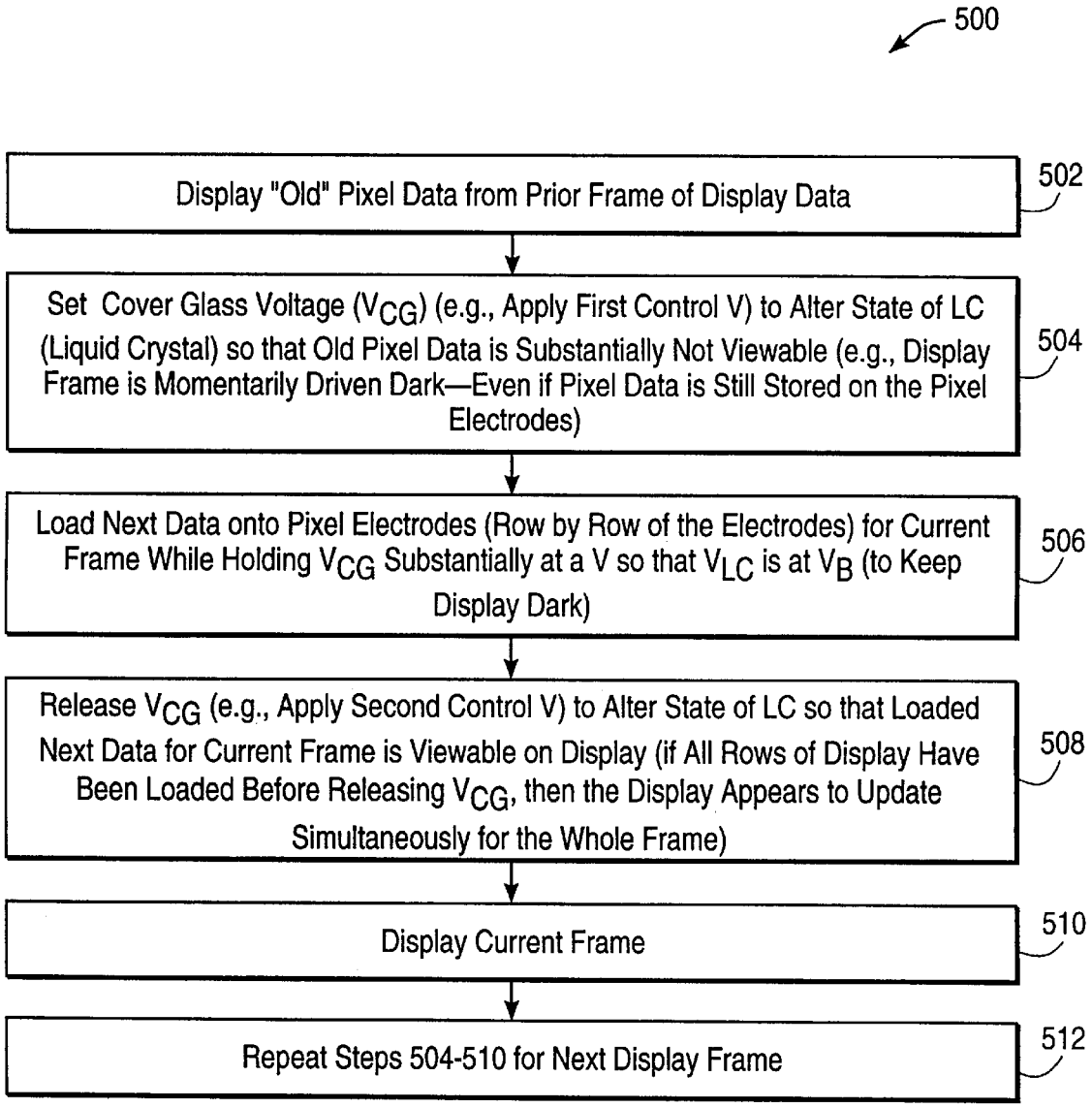
FIG. 5 illustrates an embodiment of the present invention which uses a spatial color display wherein each pixel includes three subpixels, each displaying a particular light component.

FIG. 5 shows a method 500 according to another embodiment of the present invention. This embodiment utilizes a system having a spatial color first substrate, wherein for each pixel there are three subpixels which provide the three signals for three primary colors, such as red, green and blue. These spatial color systems are well known in the prior art. The present invention provides an advantage in these systems in that simultaneous update may be achieved while also providing frame-to-frame independence without having to incorporate a pixel buffer for each pixel to thereby provide a frame buffer on the same substrate with the pixel electrodes. Method 500 begins in step 502 in which "old" pixel data from the prior frame of display data is displayed in the display system. Then in step 504, the control electrode receives a control voltage which alters the state of the liquid crystals such that the old pixel data is substantially not viewable even if the pixel data is stored on at least some of the pixel electrodes. As a result, typically in most embodiments of the present innovation the display frame is momentarily driven dark. In step 506, the next data for each pixel is now loaded onto the pixel electrodes in a row-by-row manner as in the prior art for the current frame while continuing to keep the voltage on the control electrode substantially at a voltage so that the voltage across the liquid crystal is preferably at or above $V_B$. Then in step 508 the voltage on the control electrode is changed to the second control voltage to thereby allow the liquid crystal to change its state so that the loaded next data (loaded in step 506) for the current frame is now viewable on the display. If all of the rows of the display have been loaded before releasing the voltage on the control electrode, then the display appears to update simultaneously for the whole frame even though the pixel electrodes were updated simultaneously only on each row at a time. Then in step 510, the current frame is displayed for some duration. Step 512 involves the repeating of steps 504–510 (inclusive) for the next display frame. In this manner, a spatial color display system may achieve improved frame-to-frame independence while at the same time achieving simultaneous update for the whole frame without having frame buffering on the same substrate as the pixel electrodes.

FIGS. 6A, 6B, 6C and 6D show various pixel circuits which may be employed with the present invention. For example, the circuits of FIGS. 6A, 6B, and 6C may be employed where no frame buffering on the pixel electrode substrate is required. Each of these circuits include at least one pixel electrode, such as pixel electrodes 651, 661, or 671, and further include control transistors which are used to selectively load the pixel electrode. These control transistors are shown as FET's 652 of FIG. 6A, 662 and 663 of FIG. 6B, and 674 of FIG. 6C. The operation of these pixel circuits is well known in the art, and it will be appreciated that there is an array of such circuits wherein the array includes a plurality of rows of the pixel circuits where each row includes a plurality of columns of the pixel circuits.

FIG. 6D shows a pixel circuit which may be used with certain embodiments of the present invention which require pixel buffering in pixel buffers located on the same substrate with the pixel electrodes. The pixel circuit of FIG. 6D includes a conventional row select wire 687 and a data or column wire 686 and also includes a control or pass transistor 685. This pixel circuit further includes a pullup FET 682 and a pulldown FET 683 as well as a voltage follower FET 684. This pixel circuit of FIG. 6D operates in the following manner: while old pixel data values are being held or stored on the pixel electrode 681 (with the pulldown signal 688 being kept low such that the FET 683 is off) a new pixel data value is loaded into the pixel circuit or cell by applying a high row select signal on row select wire 687 and concurrently applying the pixel data value on data wire 686. In this condition, the FET 685 passes the pixel data value, which is preferably an analog pixel data value, through to the gate of the FET 684 which should not be in a conducting state at this point since the pullup signal is kept low so that substantially no current is flowing through the source/drain electrodes of either FET 682 or FET 684. After loading the next pixel data value onto the gate of FET 684, the FET 685 is turned off by driving the row select wire 687 low. This will keep the new pixel data value stored on the gate of FET 684 while data wire 686 applies another new pixel data value to a pixel cell in the same column but a different row. Then, near the end of the display of the old pixel value on pixel electrode 681, the pulldown signal 688 is asserted high, thereby turning on FET 683 which then discharges any charge on the pixel electrode 681. Then the pulldown signal 688 is turned low again to turn off the FET 683 and then the pullup signal is asserted high to turn on the FET 682. This causes the FET 684 to pull up its source node which is coupled to the pixel electrode 681 to within one transistor threshold value of the pixel data value (preferably an analog pixel data value) stored on the gate of the FET 684. After this pullup occurs, the pullup signal is deasserted to a low value to cause no current flow through the FETs 682 and 684 thereby allowing the value stored on the pixel electrode 681 to control the display state of the liquid crystal in the proximity of the pixel electrode 681. It will be appreciated that an array (in rows and columns) of pixel circuits of the type shown in FIG. 6D will provide, in one embodiment, an analog frame buffer in the same integrated circuit (monocrystalline silicon) substrate as the pixel electrodes. Moreover, each such pixel circuit may be fabricated such that it is disposed under each pixel electrode, which in one embodiment may be a reflective mirror for a reflective type liquid crystal display.

Figure 7A:
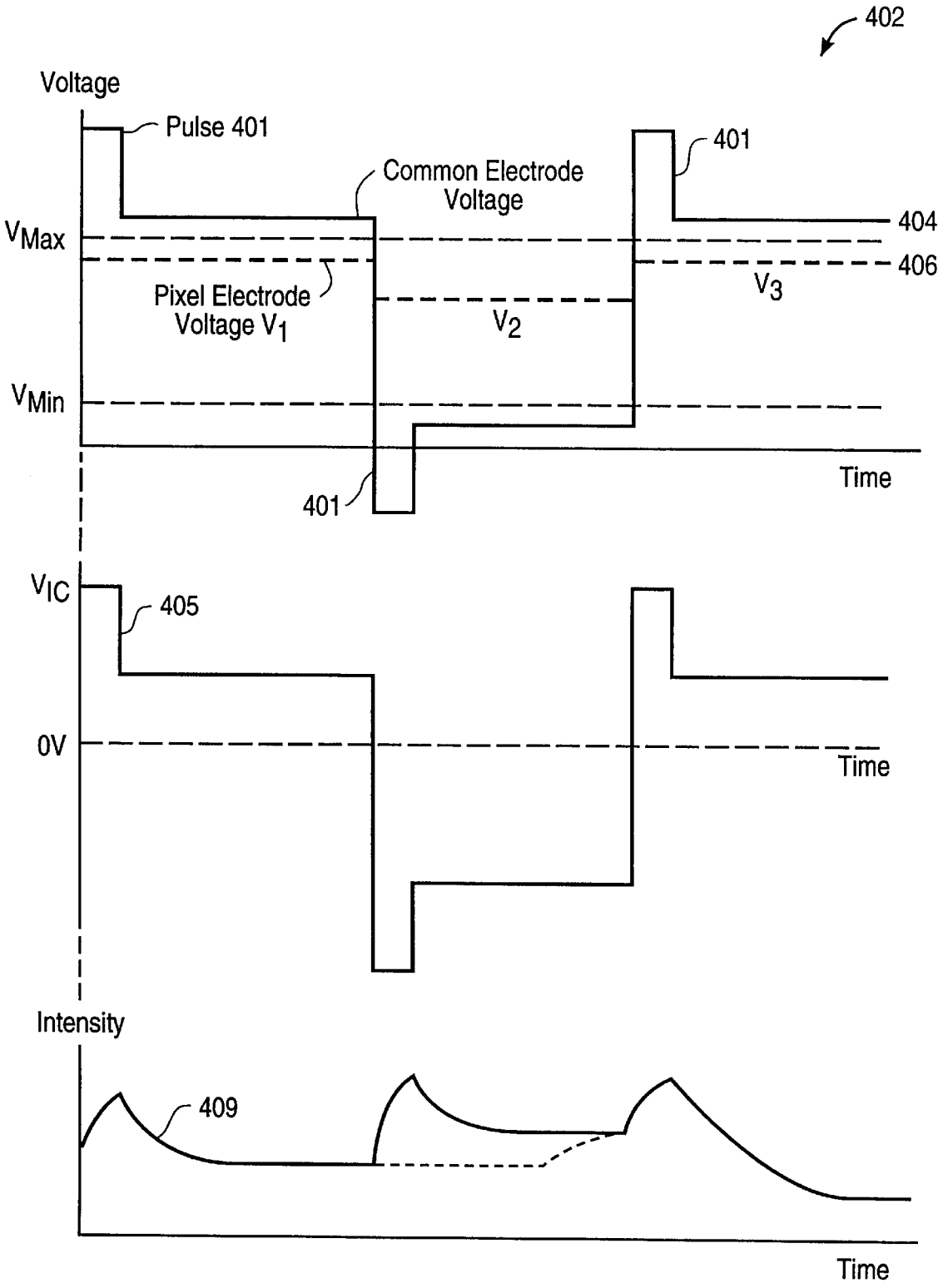
FIG. 7A shows the effects of modulating the electrode voltage modulation with a signal that is not a rectangular waveform, according to an embodiment of the invention in which the upper panel shows the electrode voltage and the pixel electrode voltage with respect to time when an overdrive pulse is applied, and the middle panel shows the voltage across the electro-optic layer (e.g. liquid crystal layer) for such modulation of the electrode and the lower panel shows the intensity output from the pixel A using the overdrive pulse (solid line) and without the overdrive pulse (dashed line).

FIG. 7A shows an example of a liquid crystal pixel switching between gray levels or color levels. This figure depicts the optical response from a single pixel (pixel A) switching between levels over three frame periods. In this example, the liquid crystal is driven toward a bright state by increasing voltage, and the DC balance is affected by alternating the polarity of the cover glass voltage with respect to the pixel voltage on a frame-by-frame basis. The figure shows the effects of modulating the common electrode voltage modulation with a pulse which is designed to alter the light altering state of the liquid crystal such that display data is not usefully viewable. In this instance, rather than being driven dark, the display is driven whiter and yet the display data is not usefully viewable as the whole display will be driven brighter. It will be appreciated that it will generally be preferable to not illuminate or view the display during the state in which the display is driven whiter by the pulses 401.

Referring to FIG. 7A, the upper section of this figure shows the voltages at the control electrode or common electrode and the pixel electrode voltage with respect to time when the pulse 401 is applied. The middle section of FIG. 7A shows voltage across the liquid crystal for such modulation of the common electrode voltage, and the lower section of FIG. 7A shows the intensity output from pixel A with the pulse 401 and without the pulse 401 (where the response without the pulse 401 is shown by the dashed line). The pulse 401 need not be limited to a flat pulse, and it can be positive or negative with respect to ground and can even alternate between positive and negative as shown in FIG. 7A. It will be appreciated that this pulse is similar to the pulse on the voltage waveform 151 which occurs between times $t_0$ and $t_1$ of FIG. 2C.

The amplitude and duration of the pulse 401 of FIG. 7A at the beginning of a frame period are chosen such that the pulse momentarily drives the liquid crystal beyond the target gray value. For the display as described above, the duration of the pulse can be from a fraction of a millisecond to over one millisecond and the amplitude can be any value that yields a pulse 405 with a voltage level $V_{LC}$ across the liquid crystal layer which is sufficiently large to produce an intensity surge 409 at pixel A. In an alternative embodiment, of course, the liquid crystal may be driven dark rather than driven bright. Since the pulse 401 is applied to all pixels which share the electrode, it results in an increased switching time between one gray level and a darker gray level. It has the advantage that the time switching between one gray level and a slightly lighter gray level is not limited by the observed delay, and slow response in such situations (this is indicated by the dashed line in FIG. 7A). Indeed, the upper limit for the time taken for any transition is now bounded by the relaxation time after the pulse. In one embodiment, the additional or superimposed pulse may be temporally close to the update or acquisition of image data on the pixel electrodes.

Figure 7B:
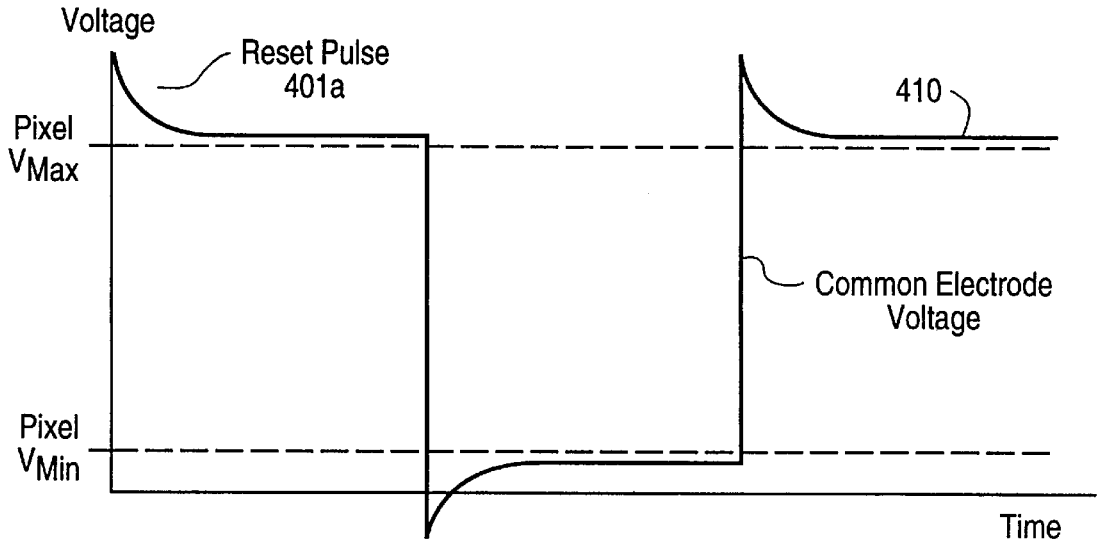
FIG. 7B shows a waveform of the modulation of electrode which may be used to drive the electro-optic layer to a state in which display data is not visible, wherein the waveform uses a reset spike rather than a rectangular pulse.

FIG. 7B shows another approach to modulating the control electrode, such as a common cover glass electrode for a sequential display device using a pulse with a voltage that peaks with an exponential type decay. The pulse may, for example, be added near the time at which all the pixels are updated.

Figure 7C:
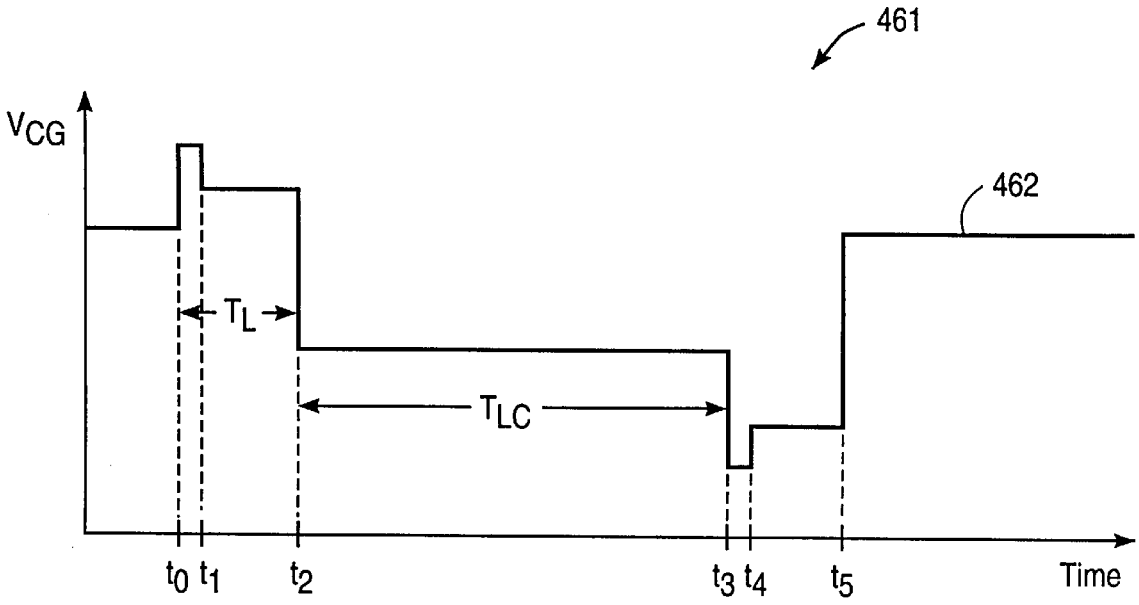
FIG. 7C illustrates a waveform for an electrode modulation which may be used to place the electro-optic layer into a state in which the display data is not visible according to one embodiment of the present invention.

FIG. 7C shows another alternative embodiment for modulating the voltage on the control electrode. The modulation pattern 461 has a voltage waveform 462 that includes several components as shown in this voltage versus time diagram. A frame cycle begins at time to in which the voltage on the control electrode is ramped to a high enough voltage such that $V_{LC}$ is driven close to $V_{OD}$ (see FIG. 2B). This voltage state continues during the duration between time $t_0$ and time $t_1$ (the "reset" voltage). This causes the liquid crystal to be rapidly driven to a state in which the display data is not viewable. Then from time $t_1$ to $t_2$, the voltage on the control electrode is changed so that instead of overdriving the liquid crystal layer, it is held at a voltage such as $V_B$, the "hold" voltage (see FIG. 2B). The time from time $t_1$ to $t_2$ may be utilized by the display system to load all the pixel electrodes with new display data for the current frame (and effectively erasing the old display data) then at time $t_2$ the pixel data may begin to be displayed. Typically, all pixel electrodes would have been loaded by the beginning of time $t_2$ and thus all liquid crystal can begin the transition from the altered state which existed during the time between $t_0$ and $t_2$ to a relaxed state. The relaxation of the liquid crystal is allowed to occur between times $t_2$ and $t_3$ which is also the time in which the image data is being displayed at least part of this time period, which may be referred to as the view period. This is done by changing the cover glass voltage to the view voltage. Typically, the time between $t_2$ and $t_3$ includes illumination of the display for at least a portion of the time if not all the time. Moreover, rather than illuminating continuously through a portion of the time between $t_2$ and $t_3$, pulses of illumination may be applied. For example, one pulse of illumination may be provided at the end of each color frame (if spatial color) or at the end of each color subframe (in the case of a time sequential color display system). The modulation scheme of FIG. 7C thus achieves an advantage of rapidly driving the crystal to an altered state in which the display data is not viewable while then relaxing it but still keeping it not viewable. This decreases the response time of the device thereby allowing the frame rate of the display device to be driven at higher frequencies, subject to the amount of time it takes to load the pixel electrodes in the frame. The cycle beginning at time $t_3$ continues except the polarity of the signals has changed due to the fact that the control voltage signal applied to the control electrode is DC balanced around some DC level (shown here as some level other than zero volts). It will be appreciated that DC balancing is performed in order to attempt to provide a DC balanced signal to the liquid crystal such that the DC balance level of the liquid crystal is approximately zero volts.

In another embodiment of the present invention, the control voltage which is applied to the control electrode is modulated with a burst of a relatively high frequency oscillation (e.g. 5 kHz to 100 kHz). Such a scheme would be useful for driving dual-frequency liquid crystal materials in those types of displays where below the crossover frequency the liquid crystal material has a positive dielectric anisotropy, and above the crossover frequency it has a negative dielectric anisotropy.

As an example of the usefulness of a display system featuring such a scheme, consider the following scenario. An image is written to display system 12 by applying a pattern of voltages to the array of pixel electrodes 28. Common electrode 26 is modulated according to an embodiment of the invention as described above, or alternatively, may be clamped at a given voltage while each pixel of electro-optic layer 22 switches to the desired state. Then after the image has been viewed, it is desired to rapidly reset each pixel of the electro-optic layer 22 to an off state in preparation for the acquisition of the next set of image data such that the old image data is not viewable while acquiring the new set of image data or if acquired already, may be separated from the prior frame by momentarily blanking the display. This can be achieved by using a dual-frequency electro-optic liquid crystal material and performing this reset, or drive to off function, by applying a short period of high frequency voltage signal to the common electrode 26. It will be appreciated that if an AC signal is used to hold the liquid crystal to a state in which the display (pixel) data is substantially not viewable (e.g. a "dark" state), then it is preferred to synchronize the phase of the AC signal with the phase of writing pixel data to each row of pixel electrodes so as to equalize between rows the effect of capacitive coupling between the control electrode (e.g. the common electrode) and the pixel electrodes.

Within the basic scheme for electrode modulation of the present invention, in which the electrode voltage has a close temporal relationship with the update of image data to the pixel electrodes, there exists a number of variations concerning the nature of the modulation. Here the modulation may consist of pulses of shorter duration than that of the image data on the pixels. In another embodiment of the control electrode voltage modulation scheme according to the present invention, the pulse duration applied to the control electrode may be of longer duration than that of image data on the pixels. In this latter case, the time period with which the image data remains on the pixels is shorter that the refresh period.

According to another embodiment of the invention, the control electrode voltage modulation may comprise bursts of relatively high frequency alternating current (AC) modulation. In another embodiment, the control electrode voltage modulation may comprise one burst of relatively high frequency modulation for each update of image data to the pixel electrodes.

Figure 8:
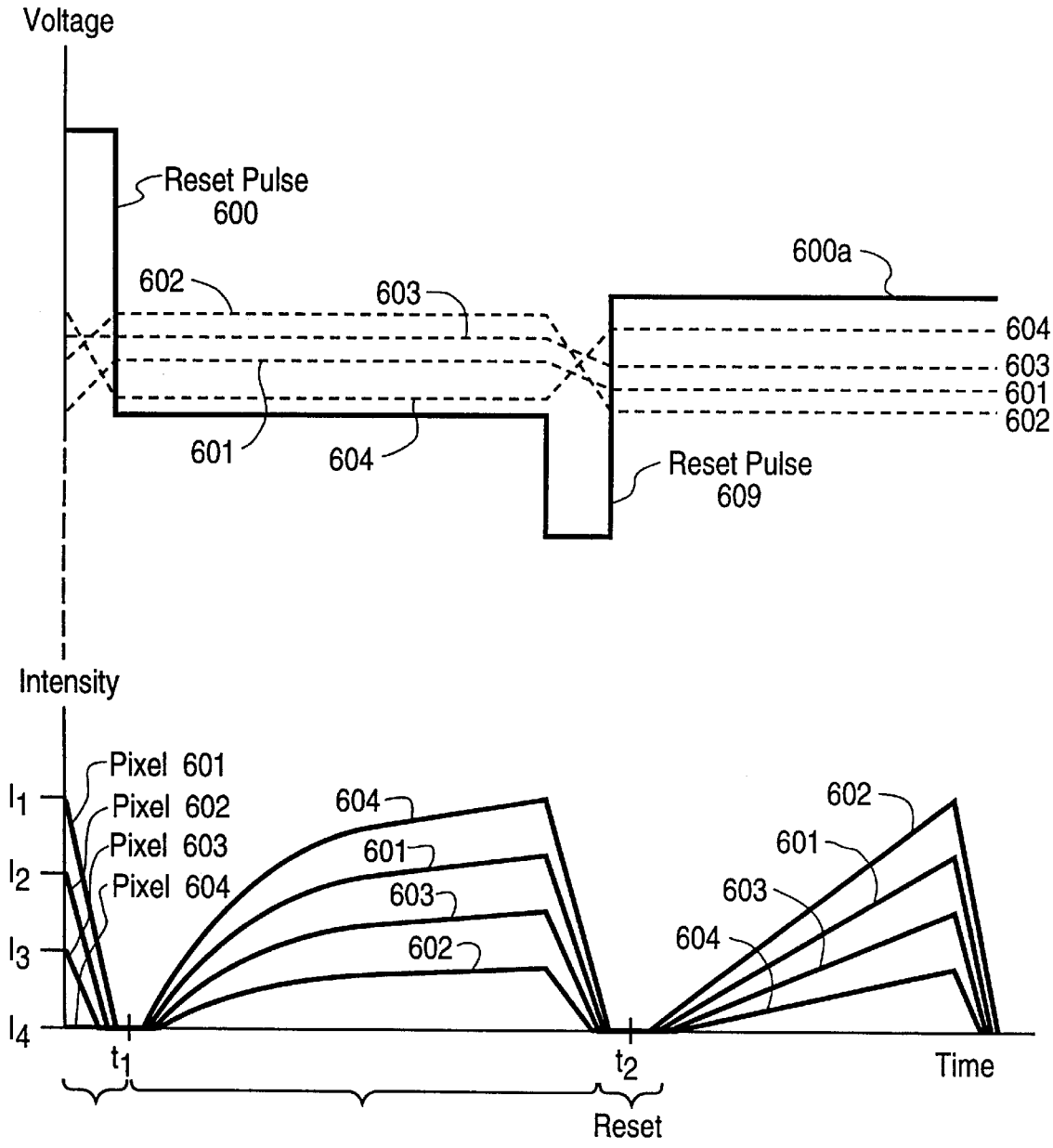
FIG. 8 is a waveform illustration indicating the electrode modulation voltages and the pixel electrode voltages over time using a frame buffering system; the electrode modulation shown in FIG. 8 includes a reset pulse which is designed to place the electro-optic layer into a state in which the display data on the pixel electrodes is not viewable.

As shown in FIG. 8, according to a further embodiment of the present invention, the common electrode voltage can be modulated with a pulse to achieve a rapid "drive to dark" of the electro-optic material or liquid crystal despite any pixel data stored on the pixel electrodes during the drive to dark state. Certain liquid crystal cell configurations can be constructed which are normally white, and require addressing by a voltage to drive the cell to a dark state. According to this embodiment, this voltage addressing can be done by driving the common electrode to a voltage sufficiently different from the pixel voltage to achieve a rapid drive to dark Gray or color levels are subsequently established by allowing the liquid crystal to relax back and generate different gray or color levels depending on the voltage on the pixel electrode. It will be appreciated that gray may be considered a color for the purposes of the present invention. The embodiment shown in FIG. 8 also utilizes a pixel frame buffer which stores the next pixel data in a pixel buffer while the current pixel data is being displayed.

The common electrode voltage can be over driven to get the electro-optic material very quickly to a dark state by using a voltage greater than the voltage required to hold a dark state.

An example of an electro-optic response which would be suitable for this embodiment is shown in FIG. 2B. The intensity output from a pixel decreases with the voltage applied across the electro-optic layer. The electro-optic curve shown here has a saturation response as the voltage is increased above the "black holding voltage", that is, the output remains dark for higher voltages. The present invention may also be used with liquid crystals having different electro-optic curves, such as one which is similar to that shown in FIG. 2B except that the curve 125 begins to rise again at some point after point 127 (e.g. perhaps before $V_{OD}$) rather than remaining flat, in which case $V_{OD}$ would not normally be applied to such a liquid crystal. Alternatively, a thick liquid crystal layer may be used which has a more complex curve, which curve 125 may be considered to be a portion of; in this case of a thick liquid crystal, the useful portion of the curve 125 may be used without allowing the crystal to relax completely to other portions of the complete, complex curve. It will also be appreciated that, for certain liquid crystals, different electro-optic (EO) curves may exist for different colors (e.g. a liquid crystal may have a first EO curve for one color (with a $V_B$ of $V_B$ EO1) and a second EO curve for another color (with a $V_B$ of $V_B$ EO2)). In this case, it is desirable to coordinate the control voltage applied to the control electrode relative to the color such that the control voltage matches the color and EO curves. In this case, care should be taken to make sure that the $V_B$ across the liquid crystal created by the electrode is sufficient to render the prior pixel data unviewable before the next pixel data is to be displayed.

The relaxation to the gray scales happens through a related family of curves which, even if the material slows down through temperature decrease, will still allow the viewing of gray or color levels. Subsequent images are independent of each other since there is a complete reset of the electro-optic material between each image.

A longer viewing time can be achieved in systems which employ time sequential color illumination or time sequential color filtration because, as the reset cycle makes color subframes independent of each other, the device can be viewed even as the material approaches the final gray or color level for a frame from the dark state. It may also be useful to view the pixels even during the rapid reset phase to gain more light throughput. A color sequential scheme is shown in FIG. 9.

Figure 9:
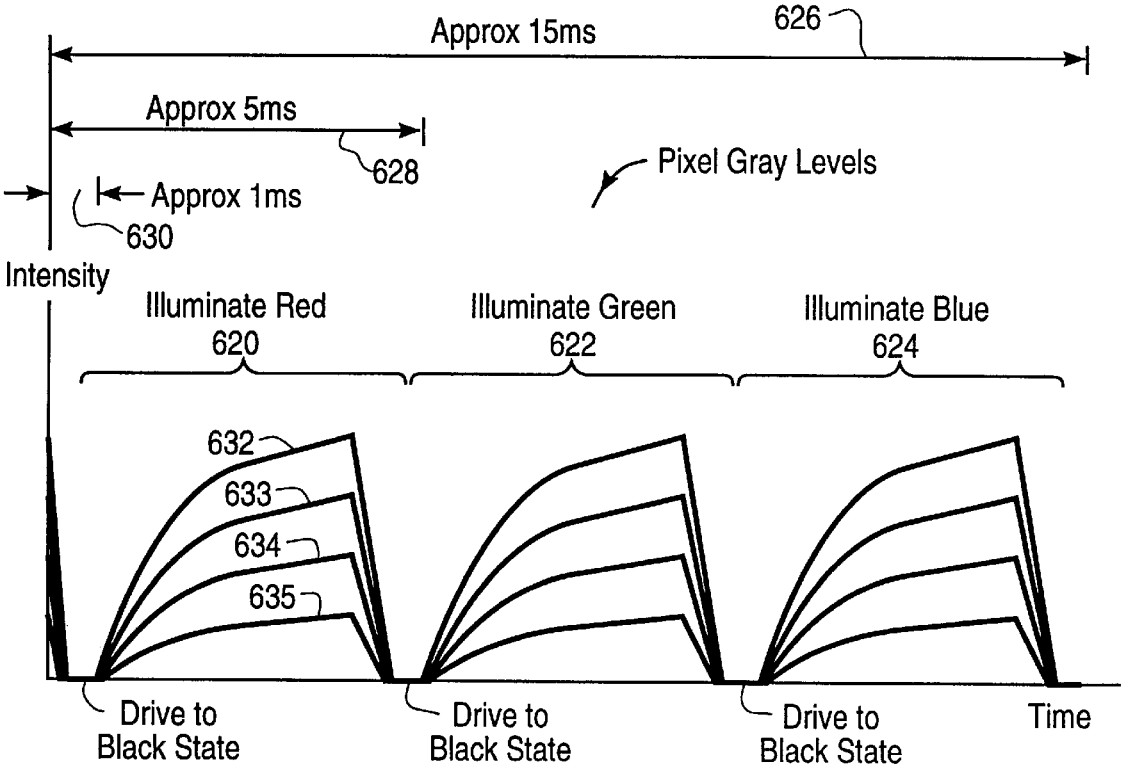
FIG. 9 illustrates a plurality of intensity versus time waveforms which illustrate the behavior of pixels in a time sequential color display system of the present invention which utilizes electrode modulation such that the electro-optic layer is placed in a state for a certain period of time in which the display data is not viewable.

In particular, FIG. 9 shows the rapid drive to dark after each color subframe. Each color subframe can have approximately a 5 ms duration in which it is illuminated continuously during the whole duration or continuously only a portion of the duration or illuminated with only non-contiguous pulses of illumination during the duration. A red subframe, green subframe, and blue subframe can be sequentially displayed within approximately 15 ms. These time periods are merely examples of durations that can achieve visual integration according to U.S. patent applications Ser. Nos. 08/505,654 and 08/605,999, the contents of which are incorporated herein by reference. It should be understood, however, that other durations could achieve this including subframe display durations less than 5 ms and even durations of 10 ms or more.

Referring to FIGS. 8 and 9, a reset pulse 600 is applied to the pixel electrode for a small portion (here 1 ms) of the subframe duration (here 5 ms). Assume there are four pixels 601, 602, 603, and 604 with respective initial intensities of I1, I2, I3, I4 and with respective intensities displayed as labeled with reference numerals 601, 602, 603, and 604 on the intensity versus time diagram of FIG. 8. Once reset pulse 600 is presented to pixels 601–604, their intensities drop from I1–I4 to zero, respectively, i.e., they undergo a rapid drive to dark at time $t_1$. Note that the display does not show viewable data even though the pixel electrodes have pixel data values thereon. Also note that all pixel electrodes simultaneously receive updated pixel data values (As shown by the immediate and universal change at the very beginning of the pulse 600 and the pulse 609). This is because the display system of FIG. 8 uses pixel frame buffering, which is typically implemented by including a pixel buffer (e.g. analog pixel buffer) with each pixel electrode (e.g. as in FIG. 6D). The intensities labeled with the reference numerals 601, 602, 603, and 604 on the intensity versus time diagram of FIG. 8 then increase to their respective gray/color levels after the reset pulse stops. As depicted, pixel 604 is driven to the brightest gray or color level. The brightness of each pixel as it appears to an observer should be proportional to the area under each curve labeled with the reference numerals 601, 602, 603, and 604 on the intensity versus time diagram of FIG. 8. A following reset pulse 609 then drives pixels 601–604 to dark at $t_2$. The following relaxation to gray or color levels is shown with slower intensity versus time transitions as might occur when the liquid crystal at the pixels is cold. As can be seen, frame (or subframe) independence is achieved for pixels 601–604 even if the pixels are cool. It will be appreciated that the use of a frame buffer (as in FIG. 8) with the present invention potentially allows a short reset pulse to be applied (to make the prior frame substantially unviewable) without having to hold the reset pulse while the pixel electrodes are loaded. Since an entire frame of pixel data may be loaded from the frame buffer (of pixel buffers) onto the pixel electrodes by applying a load signal (e.g. appropriately applied pullup and pulldown signals as described for the pixel circuit of FIG. 6D) to all pixels, the time required for loading of pixel electrodes is much shorter than a non-frame buffer system which is loaded one (or two) rows at a time. Thus, the frame-to-frame independence may be achieved with a shorter reset pulse (and without the need for a longer hold pulse which is required to load the pixel electrodes).

Liquid crystal configurations can be considered which would not normally be suitable for some applications. For example, a thick cell may be easier to manufacture but will likely to have a response which is too slow. By overdriving to get a fast reset to dark, and then viewing gray scales or color levels as the cell relaxes, good performance can be achieved even if the cell never reaches its final state for that addressing voltage. The reset makes this viable because of frame independence.

This embodiment can be made to work with different types of DC balancing. Frame based, column based, row based or even pixel-by-pixel DC balancing can be implemented simply by clamping the common electrode at $(V_{max}-V_{min})/2$ and ensuring that subsequent drive to dark pulses are of alternate polarity. In that case, the liquid crystal is DC balanced by controlling only the data driven to the pixel electrodes.

Frame inversion DC balancing can also be implemented in a scheme which modulates the common electrode voltage. An example of this is shown in FIG. 8. In general, DC balance can be maintained with this drive to dark scheme by ensuring that the pixel electrode data updates and the drive to dark pulse sequence are arranged so that over a number of update cycles, the voltage across the electro-optic later averages to a value close to zero.

The pixel electrodes can either be clamped at some known voltage during the reset period or they can be left in some arbitrary state if the common electrode drive is sufficiently high voltage.

An initial reset can be applied with all pixels set to zero volts. The electro-optic device, e.g., a liquid crystal device, has all pixels go rapidly to dark The pixels are then all set to their gray or color level voltages and the liquid crystal display begins to relax to the gray or color level corresponding to those voltages. The device can be viewed through this entire relaxation (and also though the next reset) because this image is not contaminated with the previous one. The next reset is shown with the pixels set to their highest voltage and the common electrode driven negative. The next image is shown with the common electrode set at the maximum pixel voltage and pixel electrodes below that. Hence, in this particular example DC balance is achieved on a frame-by-frame basis.

It is important to note in this embodiment of the present invention that it is possible to achieve essentially simultaneous drive to dark in the optical output of a large group of pixels, such as an image even if the pixels do not have the facility to perform a simultaneous update of their electrodes with new data. Furthermore, it is possible to make pixels appear to have the facility for simultaneous electrode voltage update by using the present invention.

This present invention describes several modifications to the display driving system which has been described above. There are at least three modifications which may be made to the various embodiments of this drive system. These modifications may be made independently or in some combination. One modification relates to a technique for decreasing the voltage transition of a control electrode from a reset or hold state to a view state. Another modification relates to the use of different view voltages (or other voltages such as reset and/or hold voltages) on the control electrode, such as a cover glass electrode, depending on the color that is being displayed in a time sequential color display system. Also, different hold and reset voltages on the control electrode may be used for the different colors in a time sequential color display system. Another modification relates to the use of the reset (and optionally hold) and view voltages to compensate for different brightness responses that may result from a DC-balanced drive scheme where there is a polarity inversion in the voltage waveforms. These various modifications will be described further below.

Figure 10:
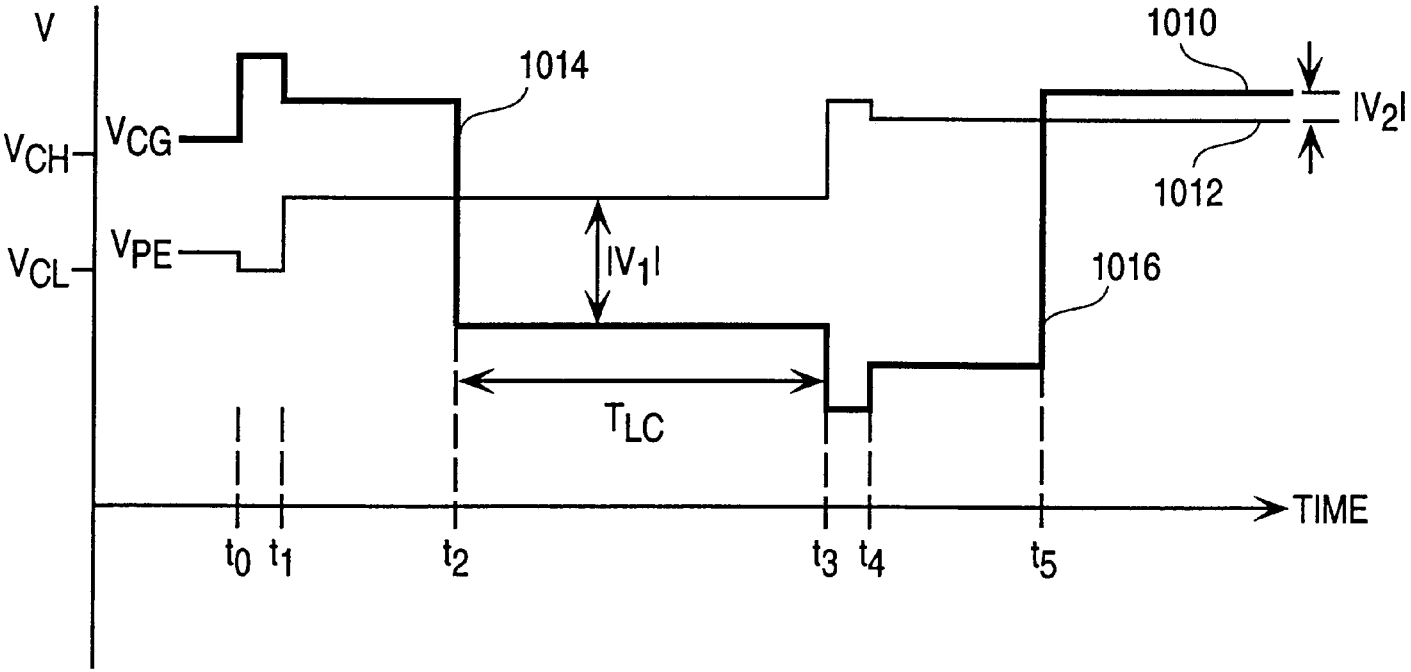
FIG. 10 shows an example of a voltage waveform which may be applied to control electrode, such as a cover glass electrode, in accordance with an example of the present invention.

FIG. 10 shows one embodiment of a reset, hold and release technique. This figure shows a voltage versus time graph of two voltage waveforms. In particular, voltage waveform 1010 represents the voltage on the cover glass electrode or other control electrode over time. Voltage waveform 1012 shows the voltage on a particular pixel electrode over time. The waveform 1010 shows that the cover glass electrode receives a reset voltage during the time period between times $t_0$ and $t_1$ and also between the times $t_3$ and $t_4$. The period of time between times $t_1$ and $t_2$ is the first hold period shown in FIG. 10, and the time between the times $t_{4\ 1\ and\ t5}$ is the second hold period. It will be appreciated that the reset period causes the display to be reset such that the display data is substantially not viewable and similarly the display data is generally not viewable during the hold period. The pixel data is typically loaded during the hold period and then the hold is released at the two transitions 1014 and 1016 shown in FIG. 10 so that the display can show the data stored on the pixel electrodes. The electro-optic material, such as the liquid crystal, generates a display because of the voltage across the liquid crystal. The display generated by the liquid crystal in the time between times $t_2$ and $t_3$ is generated as a result of the voltage difference $V_1$, the absolute value of which is shown in FIG. 10. The display of information after time $t_5$ is caused by the voltage across the liquid crystal of $V_2$, the absolute value of which is shown in FIG. 10. FIG. 10 also shows that the pixel electrodes are clamped according to one aspect of an invention described in the filed patent application Ser. No. 08/920,602 which was filed Aug. 27, 1997. This clamping occurs while the display is reset during the interval between times $t_0$ and $t_1$ and also during the interval between the times $t_3$ and $t_4$. The clamping voltages are typically two different reference voltages ($V_{CH}$—$V_{Clamp\ High}$; $V_{CL}$—$V_{Clamp\ Low}$) which are applied alternatively over time in order to get a DC balanced signal over time on the pixel electrodes (ignoring the pixel data values). The clamping voltage is typically low ($V_{CL}$) for the "positive" (higher) cover glass voltage and high ($V_{HC}$) for the "negative" (lower) cover glass voltage.

As described in conjunction with FIG. 16C of previously filed application Ser. No. 08/920,602 (filed Aug. 27, 1997), the pixel electrode voltage tends to shift with a shift in the cover glass voltage. This previously filed application describes the use of compensating electrodes or large enough pixel capacitors in order to reduce this effect. The larger the transition from the hold or reset voltage to the viewing voltage of the cover glass then the larger this effect is. The transitions 1014 and 1016 are large transitions from the hold voltage state on the cover glass to the viewing voltage state on the cover glass electrode. For example, the hold voltage on the cover glass during the interval between times $t_1$ and $t_2$ drops through transition 1014 to a considerably lower voltage on the cover glass during the interval between times $t_2$ and $t_3$. Similarly the transition 1016 is large in order to transition from the hold voltage on the cover glass to the viewing voltage on the cover glass after time $t_5$.

Figure 11:
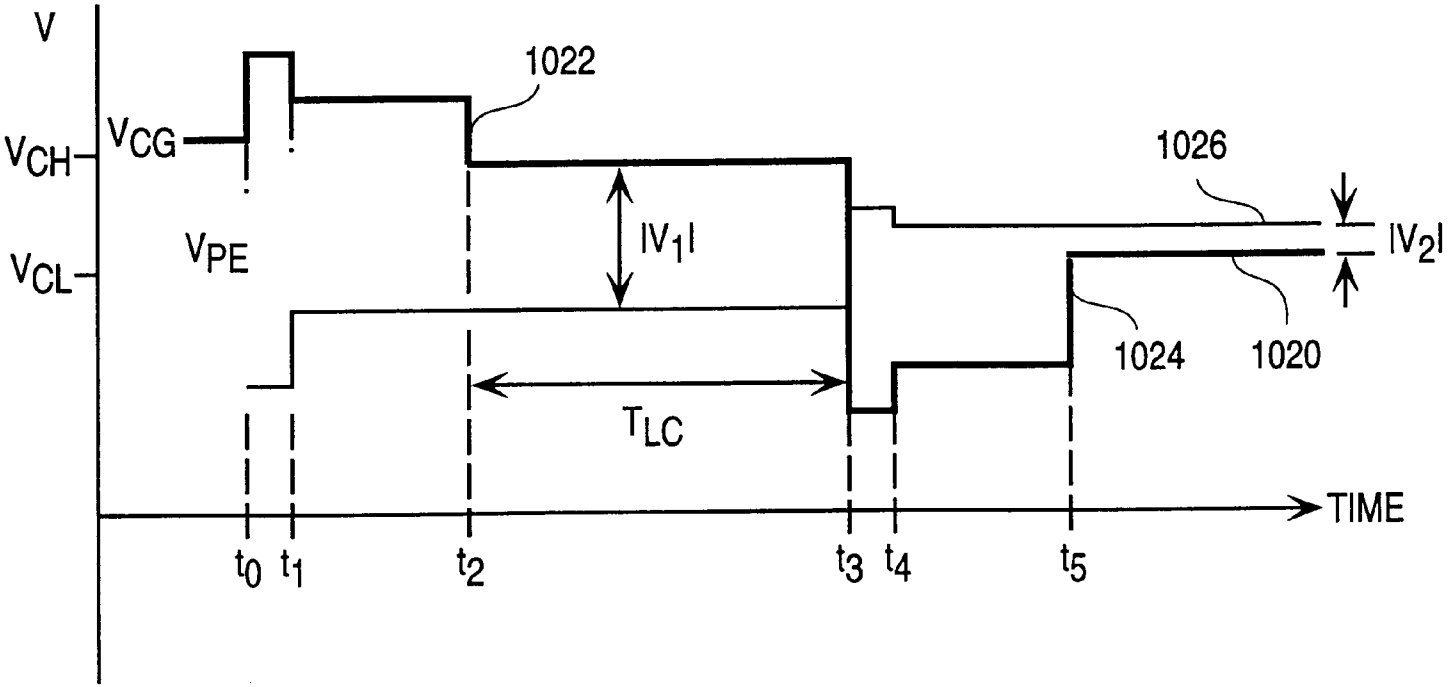
FIG. 11 shows a modified voltage waveform for a control electrode, such as a cover glass electrode, which has been modified according to an aspect of the present invention.

An alternative approach to reducing the pixel voltage shift caused by this transition is to reduce the cover glass voltage transitions at times $t_2$ and $t_5$. FIG. 11 shows an example of such a technique. Voltage waveform 1020 represents the voltage on the control electrode, such as a cover glass, and voltage waveform 1026 represents the voltage on a particular pixel electrode over time. As with FIG. 10, FIG. 11 does not attempt to show the slight shifting in voltage on the pixel electrode at the transitions which occur at times $t_2$ and $t_5$. It will be appreciated that even with the technique shown in FIG. 11 there may be some small shifting of the voltage on the pixel electrode at these transitions due to the capacitive coupling of the pixel electrode to the cover glass electrode. FIG. 11 shows that the cover glass electrode is performing the same reset, hold and release sequence of operations as in FIG. 10. For example, the display is reset by the cover glass receiving a reset voltage during the interval between times $t_0$ and $t_1$ and during the interval between times $t_3$ and $t_4$. Also during these reset times, the voltage on the pixel electrode is optionally clamped at the voltages $V_{CL}$ and $V_{CH}$ respectively. Also, during the interval between times $t_1$ and $t_2$, new pixel data is loaded onto the pixel electrode after the optional clamping operation and this pixel data is then allowed to drive the electro-optic layer, such as a liquid crystal display, during the interval between times $t_2$ and $t_3$. However, unlike the display system represented by FIG. 10, the display system of FIG. 11 utilizes inverted data on the pixel electrode during the period between times $t_2$ and $t_3$ and yet maintains the same absolute value of the voltage (the absolute value of $V_1$) in order to achieve the same display state during $t_2$ and $t_3$ as in FIG. 10. The inversion of the data takes into account the different cover glass view voltage which is applied to the cover glass during the view interval which occurs between times $t_2$ and $t_3$. The inversion of the pixel data may, as described below, be achieved by having a set of red, green and blue lookup tables for a positive cycle ($t_0$ to $t_3$) and another set of red, green and blue lookup tables for the negative cycle. Thus, the voltage transition at transition 1022 for the cover glass electrode is smaller than the voltage transition at transition 1014 of FIG. 10. Yet, the cover glass electrode voltage relative to the pixel electrode voltage is such that the difference between the two voltages is still maintained at the absolute value of $V_1$ so that the same pixel data may be displayed. During the next display cycle which begins at time $t_3$, the pixel electrode is optionally clamped during the interval between times $t_3$ and $t_4$ and then loaded with new pixel data during the interval between times $t_4$ and $t_5$. During $t_5$, viewing may occur when the cover glass electrode is transitioned from the hold voltage to the viewing voltage through the transition 1024. The voltage difference between the cover glass electrode and the pixel electrode is still maintained at the absolute value of $V_2$ as shown in FIG. 11 which is the same as the absolute value of $V_2$ shown in FIG. 10. However, the transition 1024 from the hold voltage on the cover glass during the times $t_4$ and $t_5$ to the viewing voltage after time $t_5$ is considerably smaller than the transition of the voltage on the cover glass at transition 1016 of FIG. 10. Thus, the shifting of the voltage level on the pixel electrode due to the shifting of the voltage level on the cover glass is considerably lessened by this technique. It is still desirable to have a larger capacitance (such as approximately 5 times larger) between a pixel electrode and references such as ground (through capacitance 657 in FIG. 6A) than between the pixel electrode and the cover glass electrode (e.g. electrode 653 in FIG. 6A). This limits the shift in the pixel electrode to acceptable values as the cover glass electrode voltage changes. This technique may be implemented by changing the polarity of the image data loaded during the loading or holding times, wherein the polarity takes into account the cover glass viewing voltage.

Note that the voltage transition of the cover glass electrode at $t_3$ of FIG. 11 is larger than the voltage transition of the cover glass electrode at $t_3$ of FIG. 10. This results from decreasing the voltage transitions at $t_2$ and $t_5$. The increased voltage transition at $t_3$ of FIG. 11 does not, however, result in artifacts in the display process because the display is dark (or the display data is substantially not viewable) immediately after $t_3$ and the pixel electrodes subsequently are loaded with new pixel display values.

It can be seen from FIG. 1 that the first control voltage may be considered to be the hold voltage on the cover glass electrode between times $t_1$ to $t_2$ and between times $t_4$ to $t_5$, and this first control voltage may be considered to have one of a high extreme (e.g. from $t_1$ to $t_2$) or a low extreme (e.g. from $t_4$ to $t_5$). The second control voltage may be considered to be the "view" voltage on the cover glass electrode between times $t_2$ to $t_3$ and between times $t_5$ to $t_6$, and this second control voltage may be considered to have one of a high view extreme (e.g. from $t_2$ to $t_3$) or a low view extreme (e.g. from $t_5$ to $t_6$). When a maximum voltage across the electro-optic layer is desired for a frame (or subframe if time sequential color is used), then a pixel electrode voltage is one of a high pixel extreme voltage (e.g.+4 volts) or a low pixel extreme voltage (e.g. 0 volts). In accordance with an aspect of the invention shown in FIG. 11, when the maximum voltage across the electro-optic layer is desired during the display of pixel data in a frame (or subframe) and the first control voltage was previously, during the same frame (or subframe) at the high extreme and then the second control voltage will be at the high extreme during the frame (or subframe) and the pixel electrode voltage will be at the low pixel extreme voltage. In the next frame, the polarities for this example are reversed.

Figure 12:
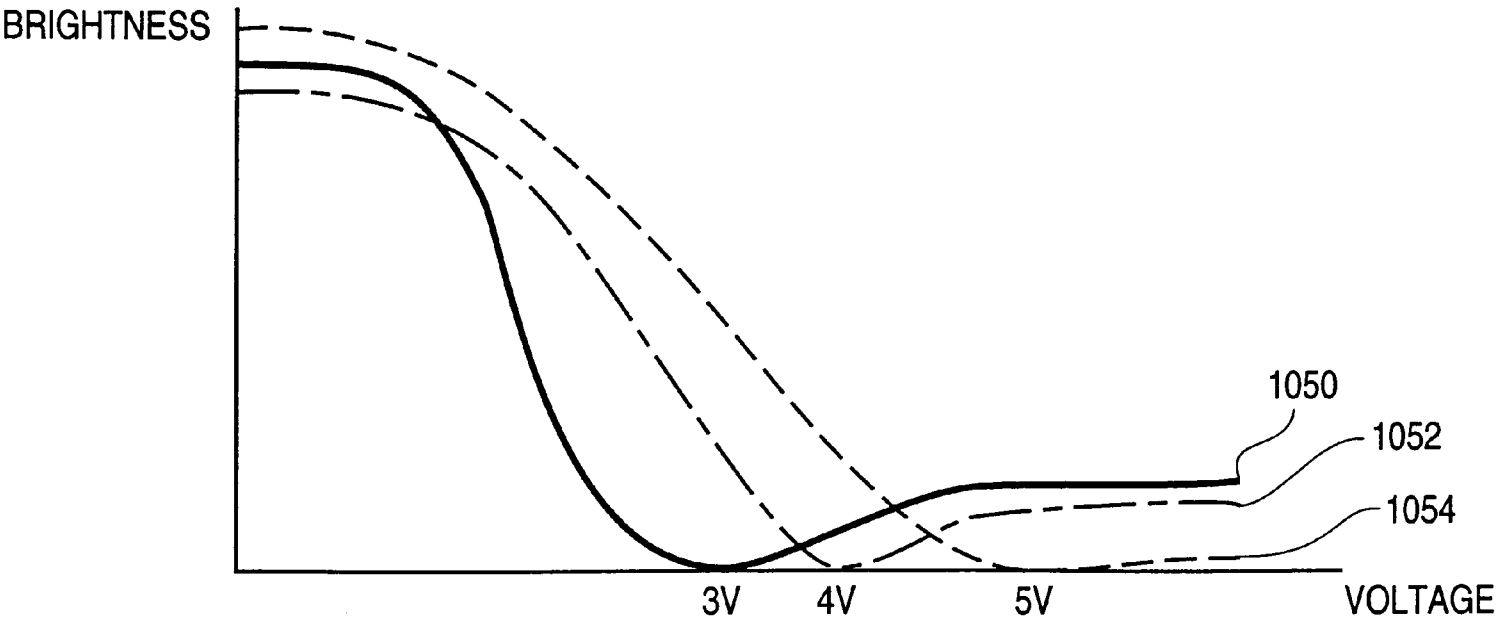
FIG. 12 shows a brightness versus voltage graph for three different electrooptic curves.

Another aspect of the present invention relates to the use of different control voltages being applied to the control electrode, such as a cover glass electrode, depending upon the color of illumination during time sequential color display. This will be described by referring to FIGS. 12 and 13. FIG. 12 is a brightness or intensity versus voltage graph showing three dynamic electro-optic curves 1050, 1052, and 1054. These curves represent fictitious dynamic electro-optic curves for an electro-optic material such as a nematic liquid crystal driven in the way described with the present invention. The graph represents the brightness integrated over some portion of the view period, as a function of voltage across the liquid crystal during the view period. The actual shape of the curve is a function of such things as the cell gap, the liquid crystal material, the temperature of use, the retarder (if any), the polarizer orientation, and other variables. For purposes of discussion, it will be assumed that electro-optic curve 1050 represents the response of the liquid crystal cell to red illumination, and that electro-optic curve 1052 represents the response of the liquid crystal cell to green illumination, and that electro-optic curve 1054 represents the response of the liquid crystal cell to blue illumination. It can be seen from FIG. 12 that the liquid crystal cell does not behave the same for each color. For example, red has maximum intensity at approximately zero volts. This red intensity rapidly decreases to a value of zero at approximately three volts at which red light will not be observed to pass through the liquid crystal cell such that the cell will appear to be dark. The curve 1052 for green light shows that the dark state during green illumination occurs at four volts and the maximum intensity also occurs at zero volts. The curve for blue light, curve 1054, shows that the liquid crystal cell is generally brighter at all voltages when blue light illuminates the cell than when red or green light illuminates the cell, and a higher voltage is required to drive this liquid crystal cell to a point where it will not pass blue light. In the example shown in FIG. 12, five volts is required to drive this cell to a state in which it appears dark.

In the following discussion, it shall be assumed that the voltage swing which is available on the pixel electrodes is between zero volts and four volts. In designing a display, it is believed that it is generally desirable to make sure that the dark voltage value is achievable for each color. This in turn specifies a voltage range for the cover glass electrode during the view period of time. In the case of the blue electro-optic curve shown in FIG. 12, to get a black state the driving electronics must produce a voltage of about five volts across the liquid crystal material. Thus if the pixel electrode is four volts, the cover glass electrode should be maintained at −1 volts. In schemes which use DC balancing, the inverted subframe for blue would set the pixel electrode at zero volts and the cover glass electrode would be set at five volts to achieve a dark or black state. Given that it has been assumed that there is only a four volt range available on the pixel electrodes, then the smallest voltage which can be put across the liquid crystal in order to get the brightest state is about 1 volt (or −1 volt in the inverted state). This lack of achieving the full voltage range across the liquid crystal during blue illumination times does tend to decrease the amount of available brightness in the blue state, but this sacrifice under the assumptions of this discussion would typically be considered to be worth doing in view of the good dark state that is achieved. While this may be acceptable for the blue illumination cycle in a time sequential color display system, it is not an optimal choice for other colors.

In the case of green, where green light is illuminating the liquid crystal display, the dark voltage state is at about four volts, and so putting five volts across the liquid crystal display when green light is illuminated would begin to increase the brightness again as can be seen from the shape of curve 1052. Given that full brightness level is accessible below four volts, there is no need to go beyond four volts. The pixel electrode voltages can be driven from zero volts to four volts and thus there is no need to sacrifice the increase in brightness between zero volts and one volt (as there was in the case when blue light illuminates a display system). Thus for the green illumination subframe, the cover glass electrode may be switched between zero volts and four volts for the positive and negative subframes. This allows the pixel electrodes to receive voltages which are available along the entire electro-optic curve between zero volts and four volts for the curve 1052.

Figure 13:
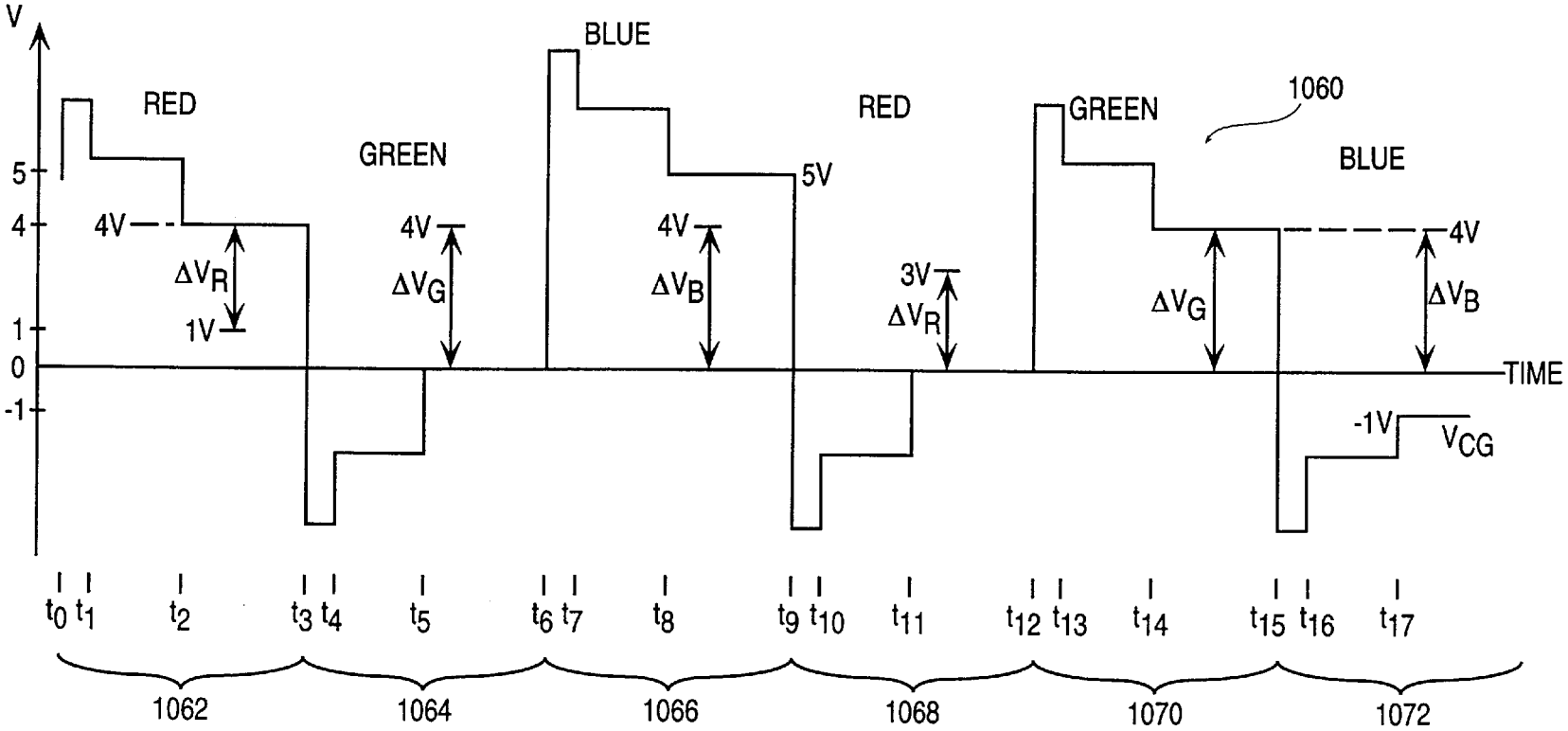
FIG. 13 shows a cover glass waveform showing the voltage differences for the different colors in accordance with an example of one aspect of the present invention. One full cycle is shown, with R, G, and B each having a positive and a negative cycle.

Curve 1050 represents the electro-optic curve of the liquid crystal cell when red light illuminates the cell during a red color subframe. In this case, the available voltage swing for the pixel electrodes is enough to access the entire useful part of the electro-optic curve 1050. A waveform 1060 for driving the cover glass electrode in a time sequential color display of the present invention is shown in FIG. 13. This waveform shows the cover glass voltage ($V_{CG}$) over time. This waveform 1060 is based upon the assumptions made above regarding the electro-optic curves 1050, 1052, and 1054 and upon the manner described above in which different voltages are applied depending upon the particular color subframe. FIG. 13 shows two full cycles of red, green, and blue color display. The first cycle comprises subframes 1062, 1064, and 1066, and the second full cycle comprises subframes 1068, 1070, and 1072. It will be appreciated that FIG. 13 in effect shows one full cycle where R, G, and B each have a positive and a negative cycle. For example, the red cycle 1062 is the positive cycle while the red cycle 1068 is the negative cycle for red. It can be seen from FIG. 13 that the viewing voltage applied to the cover glass electrode during the blue subframe (e.g. the interval between times $t_8$ and $t_9$ or the interval after $t_{17}$) is different than the viewing voltage on the cover glass electrode during the red or green color subframes. It can be also seen that the hold voltage for the blue color subframe (e.g. during the interval between times $t_7$ and $t_8$ and the interval between times $t_{16}$ and $t_{17}$) is different than the hold voltages for the red and green color subframes. Further, the reset value during the blue color subframe is different than the reset value for the red and the green color subframes. According to one aspect of the present invention, different colors may have different reset voltages and different hold voltages as well as different cover glass viewing voltages which are dependent upon the particular color of the color subframe. These are determined by the electro-optic curve for that particular color as shown in FIG. 12. One way of implementing these different voltages is to use a lookup table which provides the particular cover glass voltages during the various intervals of a particular color subframe. Thus, the various voltages shown in FIG. 13 may be stored in a lookup table and these values may be obtained by addressing the lookup table with a particular time interval which corresponds to the current time in a display cycle. It will be appreciated that it is often better to choose a cover glass view voltage which has a lower voltage difference from the prior hold voltage in order to minimize capacitive pixel electrode shifts. Furthermore it will be appreciated that it is often desirable to choose a different hold voltage for each color in order to maintain the best dark state during data loading which occurs during the hold stage, such as an interval between times $t_1$ and $t_2$.

FIG. 13 also shows the range of values the pixel electrodes may be different during the loading and viewing stages of each color subframe. Delta $V_R$ in the interval between times $t_2$ and $t_3$ represents the three volt range that the red color subframe has been designed to display in view of the curve 1050. This range is from one to four volts as shown in FIG. 13. During the negative cycle of the red color subframe which occurs between times $t_9$ and $t_{12}$, this voltage range is from zero volts to three volts during the viewing cycle which occurs during the interval spanned by times $t_{11}$ and $t_{12}$. The viewing voltages which may be maintained during viewing times for the green and blue subframes are shown as delta $V_G$ (e.g. shown in the interval between times $t_5$ and $t_6$) and delta $V_B$ (e.g. shown in the interval between times $t_8$ and $t_9$).

Another aspect of the present invention drives the display in such a way as to make the positive and negative cycles appear to have the same brightness. It has been observed that some types of liquid crystal cells do not appear to have the same brightness in both the positive and negative cycles even when the same voltage difference exists across the liquid crystal cell during both the positive and the negative cycles. This appears to arise in the case of liquid crystal cells that contain some asymmetry in the construction of the cell. Examples of such asymmetry include different electrode materials on the two cell walls, different passivation materials over the electrodes, etc. The difficulty that is observed is that the liquid crystal responds differently to the different polarity addressing of voltage across the cell (as if the liquid crystal had its own internal voltage), even though the same voltage difference exists across the cell in the two different cycles. Ideally, the same magnitude of voltage across the cell should result in the same brightness independent of the polarity of the voltage across the cell. It is appreciated that this assumes a DC-balanced drive scheme where the polarity is reversed frequently enough to prevent ionic drift and consequent image loss. The consequence of the different brightness response to the positive and negative voltages across the liquid crystal cell during the positive and negative cycles is that a flicker can be seen.

There are several possible approaches to solving this problem. For example, the asymmetry in the cell may be removed by changing the construction techniques. While this may be possible, it does add complexity to the construction of the cell. Another solution is to drive the display in such a way as to make the positive and negative cycles appear to have the same brightness. One way to achieve this may be to add a DC offset voltage to the driving voltages, such as the cover glass drive voltage. This may counteract the inherent, apparent internal voltage of the liquid crystal cell. However, this does not appear to work as the offset does not seem to stabilize the liquid crystal cell; rather the asymmetry and brightness between the different polarity cycles returns to the liquid crystal cell even after the DC offset voltage has been applied.

Another solution which may be contemplated is to modify the brightness of the illumination. However, this approach may not achieve good results because the electro-optic curve is non-linear. For example, there is very little flicker with a bright up. Adjusting the LED's to remove the flicker in the mid-gray images would cause the screen to flicker if it were bright because the flicker would now be caused by modulation of the LED. Given that a particular image on a screen includes both grays and bright portions, it does not seem to be possible to modulate the illumination device, particularly where the illumination device provides flood illumination to the entire display screen.

Figure 14:
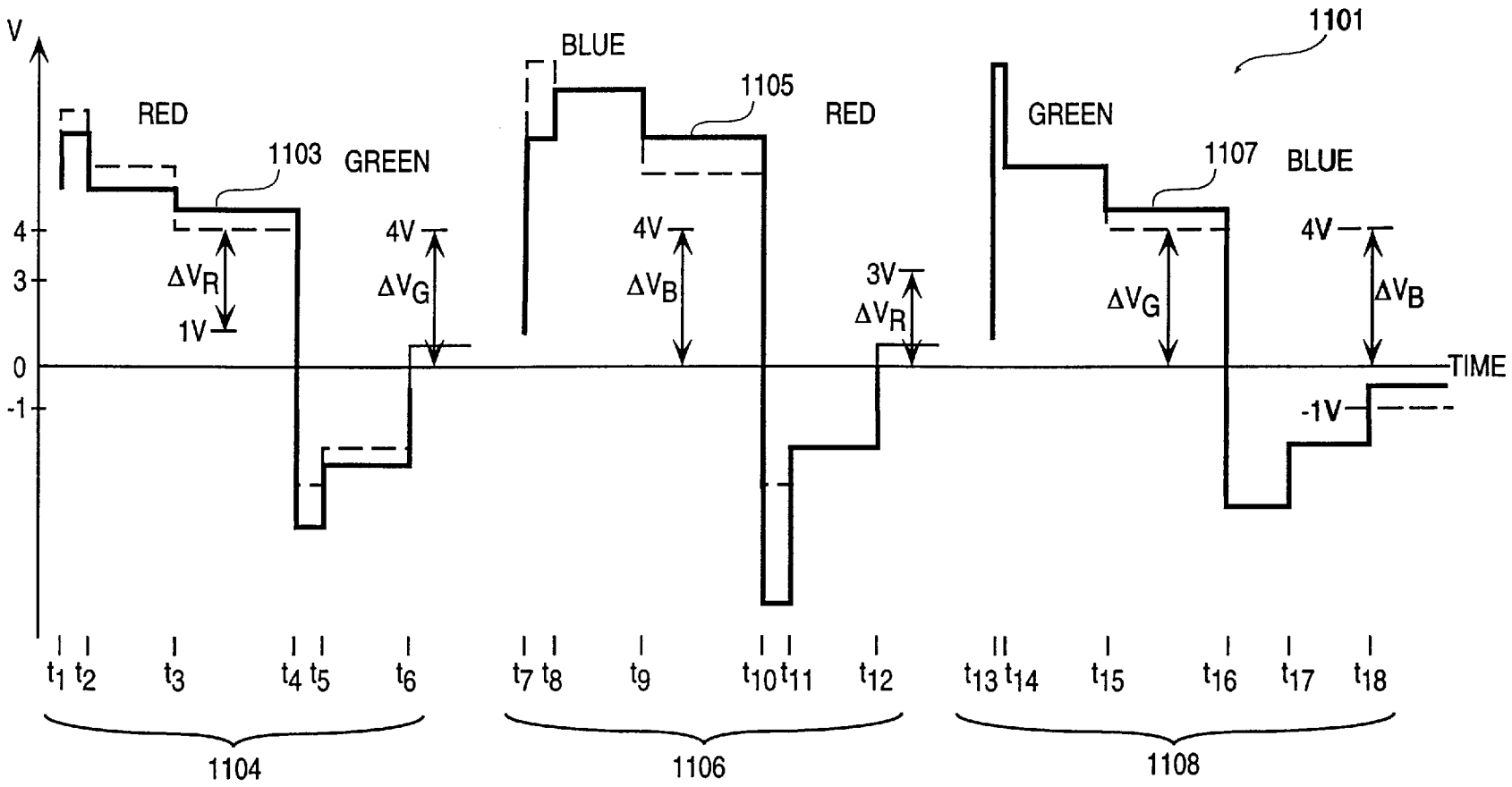
FIG. 14 shows various techniques for applying a DC offset in a controlled fashion using the reset or hold or release voltage values which are applied to the control electrode in accordance with an example of one aspect of the present invention.

The present invention provides an offset drive technique by controlling the offset supplied to the various phases of the reset and release or reset, hold and release sequence of voltages applied to the cover glass electrode or to a control electrode. For a given color, the cover glass positive view voltage and the cover glass negative view voltage are chosen so that the positive cycle and the negative cycle images have close to the same brightness. This typically means that both these voltages would be moved in the same direction (e.g. a more positive direction) in order to cause the positive cycle and negative cycle images to have close to the same brightness; this offset in the cover glass viewing voltages in both the positive and negative cycles may be as much as a significant fraction of a volt. FIG. 14 shows three different waveforms 1103, 1105, and 1107, each of which show an increase (a more positive voltage) in the cover glass viewing voltage relative to a waveform such as that shown in FIG. 13. The waveform shown in FIG. 13 is shown superimposed as a dashed line on the waveforms of FIG. 14. The three different waveforms of FIG. 14 show three different techniques according to the present invention. It will be appreciated that one of these techniques, or a mixture of techniques, may be used for all colors. In each case of these examples, each color is treated similarly, which results in all the cover glass view voltages being shifted in the same direction. This shift is offsetted by modifying the hold and reset cover glass voltages by choosing an opposite offset in proportion to their durations relative to the view time. Given that the electro-optic curves tend to be fairly flat at the high voltages where the reset and hold occur, any asymmetry induced flicker during the reset and/or hold periods is not observed. Further, if the display device is not illuminated during these times, then such asymmetry induced flicker will not be seen.

Waveform 1103 shows one technique for reducing flicker by increasing the view voltage for all colors in the same direction and then compensating for that increase by reducing the reset and hold voltages. Thus, as noted by comparing the dashed lines to the solid lines during the interval between times $t_1$ and $t_3$, the reset voltage and the hold voltage during the red subframe has been reduced while the viewing voltage is increased during the interval between $t_3$ and $t_4$. The voltage on the pixel electrodes is maintained such that it ranges from one volt to four volts for red as described in connection with FIG. 13 above. Similarly, during the green color subframe of the waveform 1103, the reset and hold voltages applied to the cover glass electrode are made more negative as shown by comparing the dashed lines to the solid lines during the interval between times $t_4$ and $t_6$. It will be appreciated that waveform 1103 represents a portion of a red, green, blue waveform for driving a cover glass electrode, which is similar to the waveform 1060 shown in FIG. 13.

Waveform 1105 represents another approach in which the viewing voltage on the cover glass electrode is increased and this increase is compensated by reducing the reset voltage only in order to DC balance. Note that in this example the positive reset voltage is shown as being lower than the positive hold voltage. This is quite acceptable as long as the combination of the reset pulse (with clamped pixel electrodes) and the hold pulse are sufficient to complete the drive of the liquid crystal to a substantially dark state.

The waveform 1107 represents yet another technique to reduce flicker by increasing the viewing voltage of the cover glass electrode and compensating for that increase by changing the duration of the reset period of time. As can be seen from waveform 1107, the reset which occurs between the times $t_{13}$ and $t_{14}$ is considerably shorter than the reset which occurs in the interval between times $t_{16}$ and $t_{17}$. In this manner, the longer negative reset in the interval between time $t_{16}$ and $t_{17}$ tends to offset the increased viewing voltage on the cover glass electrode as shown by the waveform 1107. It will be appreciated that combinations or permutations of these approaches may also be applied.

It will be appreciated that, in general, the control electrode (e.g. the cover glass electrode) receives what may be considered to be a composite signal and that a first parameter of at least one of the reset or hold (if used) or view voltages of the control electrode is selected to provide an offset, for a portion of the composite signal, from a DC balanced signal over time with respect to a particular voltage. Further, this offset is compensated for by selecting a second parameter of at least one of the reset or hold (if used) or view voltages of the control electrode. The parameters which may be selected include voltage, time (e.g. relative durations of pulses) or the shape of the voltage waveforms (e.g. a ramping view voltage).

The electrode control driver 110 of FIG. 2A may include a lookup table (LUT) and a digital-to-analog converter (DAC) which cause the driver to provide color dependent reset or hold or view voltage values; an example of these color dependent values is shown in FIGS. 13 and 14. Further, the LUT and DAC may be used to provide the offsets shown in FIG. 14. The LUT of driver 110 may receive an input which indicates the particular time period (e.g. hold for Green loading) and provides a corresponding output to the DAC which provides a voltage to the cover glass electrode. The pixel driver logic 102 of FIG. 2A may include 6 LUTs (one for each color in a "positive" cycle and one for each color in a "negative" cycle) and a DAC to cause this driver to provide color dependent pixel data values of each polarity in the manner shown in FIGS. 13 and 14. Moreover, the pixel driver logic 102 may include a LUT and a DAC for a positive cycle and another LUT for a negative cycle to provide a proper pixel voltage (which is not color dependent) relative to the cover glass's view voltage in the manner shown in FIG. 120. The pixel data input values address the LUTs and one of the LUTs' outputs for the current cycle is selected by a multiplexer and inputted to the DAC which provides the output values to the pixel electrodes. It will be appreciated that various different driver logic may be used to provide color dependent voltages, and the construction of such logic will be apparent to those of ordinary skill in the art after reviewing this description and FIGS. 10–14. In the case where voltage transitions are reduced (e.g. as shown in FIG. 10) and color dependent pixel voltages are applied to the pixel electrodes (e.g. as shown in FIG. 13), then 2 LUTs may be used for each color subframe where one LUT for a particular color subframe provides values to the DAC for a positive cycle and the other LUT for a particular color subframe provides values to the DAC for a negative cycle.

The foregoing description is considered to include the following co-pending U.S. patent applications which are hereby incorporated herein by reference: application Ser. No. 08/770,233, filed Dec. 19, 1996; application Ser. No. 08/801,994, filed Feb. 18, 1997; application Ser. No. 08/920,602, filed Aug. 27, 1997; and application Ser. No. 08/920,603, filed Aug. 27, 1997.

In the foregoing specification, the invention has been described with reference to specific exemplary embodiments thereof. It will, however, be evident that various modifications and changes may be made thereto without departing from the broader spirit and scope of the invention as set forth in the pending claims. The specification and drawings are, accordingly, to be regarded in an illustrative sense rather than a restrictive sense.

What is claimed is:

1. A method for operating a display system, said display system comprising a first substrate having a plurality of pixel electrodes, an electro-optic layer operatively coupled to said pixel electrodes and an electrode operatively coupled to said electro-optic layer, said method comprising:

applying a first plurality of pixel data values to said plurality of pixel electrodes such that a first pixel data represented by said first plurality of pixel data values is displayed;

applying a first control voltage to said electrode to alter a state of said electro-optic layer such that said first pixel data is substantially not displayed;

applying a second plurality of pixel data values to said plurality of pixel electrodes, said second plurality of pixel data values representing a second pixel data;

after applying said second plurality of pixel data values, applying a second control voltage to said electrode to alter said state of said electro-optic layer such that said second pixel data is displayed, and wherein a voltage difference between said first control voltage and said second control voltage is reduced to reduce capacitive shifting of said second plurality of pixel data values on said plurality of pixel electrodes.

2. A method as in claim 1 wherein said second plurality of pixel data values is determined relative to said second control voltage in order to reduce said capacitive shifting.

3. A method as in claim 1 wherein said first control voltage is one of a high extreme and a low extreme and wherein said second control voltage is one of a high view extreme or a low view extreme and wherein when a maximum voltage across said electro-optic layer is desired for a frame or a subframe, a pixel electrode voltage, corresponding to one of said second plurality of pixel data values, is one of a high pixel extreme voltage or a low pixel extreme voltage, and wherein, when said maximum voltage across said electro-optic layer is desired during display of said second pixel data, said pixel electrode voltage is substantially at said low pixel extreme voltage when said second control voltage is substantially at said high view extreme and said first control voltage, for said frame or said subframe, was previously at said high extreme.

4. A method as claim 3 wherein, when said maximum voltage across said electro-optic layer is desired during display of said second pixel data, said pixel electrode voltage is substantially at said high pixel extreme voltage when said second control voltage is substantially at said low view extreme and said first control voltage, for said frame or said subframe, was previously at said low extreme.

5. A method as in claim 3 wherein, when a minimum voltage across said electro-optic layer is desired during display of said second pixel data, said pixel electrode voltage is substantially at said high pixel extreme voltage when said second control voltage is substantially at said high view extreme and said first control voltage, for said frame or said subframe, was previously at said high extreme.

6. A method as in claim 3 wherein, when said minimum voltage across said electro-optic layer is desired during display of said second pixel data, said pixel electrode voltage is substantially at said low pixel extreme voltage when said second control voltage is substantially at said low view extreme and said first control voltage, for said frame or said subframe, was previously at said low extreme.

7. A method as in claim 3 wherein a first image is represented by said first pixel data and a second image is represented by said second pixel data and wherein said first image comprises a first color subframe for a first color and said second image comprises a second color subframe for a second color.

8. A method as in claim 7 wherein at least one of said low extreme and said high extreme of said first control voltage is determined by the color of said second color.

9. A method as in claim 7 wherein at least one of said high view extreme and said low view extreme of said second control voltage is determined by the color of said second color.

10. A method as in claim 7 wherein at least one of said high pixel extreme voltage and said low pixel extreme voltage is determined in part by the color of said second color.

11. A method as in claim 3 wherein said step of applying said first control voltage and said step of applying said second plurality of pixel data values overlap at least partially in time.

12. A method as in claim 11 wherein said electrode is a cover glass electrode.

13. A method as in claim 12 wherein said cover glass electrode receives a DC balanced signal over time with respect to a voltage level.

14. A method as in claim 3 wherein said display system is segmented such that said electrode covers only a portion of a display surface of said display system.

15. A method as in claim 12 wherein said display system comprises a liquid crystal disposed on a semiconductor substrate and said plurality of pixel electrodes are disposed on said semiconductor substrate.

16. A method as in claim 3 wherein said electro-optic layer comprises a liquid crystal material and wherein said liquid crystal has at least a first light altering state and a second light altering state and wherein said first control voltage sets said liquid crystal in said first light altering state such that light substantially cannot pass through said display system and wherein said second control voltage allows said liquid crystal to be set in said second light altering state such that light is capable of passing through said display system and wherein said step of applying a first control voltage further comprises applying a third control voltage after said first control voltage and before said step of applying said second control voltage, wherein said third control voltage substantially holds said liquid crystal in nearly said first light altering state and said first control voltage rapidly places said liquid crystal in substantially said first light altering state.

17. A method as in claim 16 wherein said step of applying said third control voltage and said step of applying said second plurality of pixel data values overlap at least partially in time.

18. A method as in claim 17 wherein said step of applying said third control voltage and said step of applying said second plurality of pixel data values occur substantially contemporaneously.

19. A method as in claim 3 wherein after applying said second control voltage, said electro-optic layer relaxes to a plurality of gray scale or color levels corresponding to said second plurality of pixel data values.

20. A method as in claim 19 wherein for at least a set of pixels of said first pixel data, said electro-optic layer has not reached a steady state display level specified by said first pixel data when said first control voltage is applied.

21. A method as in claim 3 further comprising illuminating said display system with at least one pulse of illumination which does not provide continuous illumination during the time that said second pixel data is available for display.

22. A method as in claim 21 wherein said second pixel data is available for display while said second control voltage is applied.

23. A method as in claim 17 further comprising applying a first reference voltage to at least one of said pixel electrodes and wherein said step of applying said first reference voltage and said step of applying a first control voltage overlap at least partially in time.

24. A display system comprising:

a first substrate having a first plurality of pixel electrodes for receiving a first plurality of pixel data values representative a first image to be displayed;

an electro-optic layer operatively coupled to said pixel electrodes;

an electrode operatively coupled to said electro-optic layer, said display system displaying said first image and then applying a first control voltage to said electrode to alter a state of said electro-optic layer such that said first image is substantially not displayed and then said display system displaying a second image represented by a second plurality of pixel data values after said electrode receives a second control voltage, and wherein a voltage difference between said first control voltage and said second control voltage is reduced to reduce capacitive shifting of said second plurality of pixel data values on said first plurality of pixel electrodes.

25. A display system as in claim 24 further comprising:

a pixel electrode driver which is coupled to at least one of said first plurality of pixel electrodes, said pixel electrode driver determining a corresponding one of said second plurality of pixel data values relative to said second control voltage in order to reduce said capacitive shifting.

26. A display system as in claim 25 wherein said pixel electrode driver comprises a memory device which stores a lookup table which specifies said second control voltage and said first control voltage.

27. A display system as in claim 24 wherein said first control voltage is one of a high extreme and a low extreme and wherein said second control voltage is one of a high view extreme or a low view extreme and wherein when a maximum voltage across said electro-optic layer is desired for a frame or a subframe, a pixel electrode voltage corresponding to one of said second plurality of pixel data values, is one of a high pixel extreme voltage or a low pixel extreme voltage, and wherein, when said maximum voltage across said electro-optic layer is desired during display of said second image, said pixel electrode voltage is substantially at said low pixel extreme voltage when said second control voltage is substantially at said high view extreme and said first control voltage, for said frame or subframe, was previously at said high extreme.

28. A display system as in claim 24 wherein, when said maximum voltage across said electro-optic layer is desired during display of said second image, said pixel electrode voltage is substantially at said high pixel extreme voltage when said second control voltage is substantially at said low view extreme and said first control voltage, for said frame or said subframe, was previously at said low extreme.

29. A display system as in claim 24 wherein, when a minimum voltage across said electro-optic layer is desired during display of said second image, said pixel electrode voltage is substantially at said high pixel extreme voltage when said second control voltage is substantially at said high view extreme and said first control voltage, for said frame or said subframe, was previously at said high extreme.

30. A display system as in claim 24 wherein, when said minimum voltage across said electro-optic layer is desired during display of said second image, said pixel electrode voltage is substantially at said low pixel extreme voltage when said second control voltage is substantially at said low view extreme and said first control voltage, for said frame of said subframe, was previously at said low extreme.

31. A display system as in claim 27 wherein said first image comprises a first color subframe for a first color and said second image comprises a second color subframe for a second color.

32. A display system as in claim 31 wherein at least one of said low extreme and said high extreme of said first control voltage is determined by the color of said second color.

33. A method as in claim 31 wherein at least one of said high view extreme and said low view extreme of said second control voltage is determined by the color of said second color.

34. A display system as in claim 31 wherein at least one of said high pixel extreme voltage and said low pixel extreme voltage is determined in part by the color of said second color.

35. A display system as in claim 24 wherein said electrode is a cover glass electrode.

36. A display system as in claim 35 wherein said cover glass electrode receives a DC balanced signal over time with respect to a voltage level.

37. A display system as in claim 24 wherein said display system is segmented such that said electrode covers only a portion of a display surface of said display system.

38. A display system as in claim 35 wherein said display system comprises a liquid crystal disposed on a semiconductor substrate and said first plurality of pixel electrodes are disposed on said semiconductor substrate.

39. A display system as in claim 24 wherein said electro-optic layer comprises a liquid crystal material and wherein said liquid crystal has at least a first light altering state and a second light altering state and wherein said first control voltage sets said liquid crystal in said first light altering state such that light substantially cannot pass through said display system and wherein said second control voltage allows said liquid crystal to be set in said second light altering state such that light is capable of passing through said display system and wherein said display system further applies a third control voltage to said electrode after said first control voltage is applied to said electrode and before said electrode receives said second control voltage, wherein said third control voltage substantially holds said liquid crystal in substantially said first light altering state and said first control voltage rapidly places said liquid crystal in substantially said first light altering state.

40. A display system as in claim 39 wherein the application of said third control voltage and the application of said second plurality of pixel data values to said first plurality of pixel electrodes overlap at least partially in time.

41. A display system as in claim 24 wherein after said electrode receives said second control voltage, said electro-optic layer relaxes to a plurality of gray scale or color levels corresponding to said second plurality of pixel data values.

42. A display system as in claim 41 wherein for at least a set of pixels of said first plurality of pixel data values, said electro-optic layer has not reached a steady state display level specified by said first plurality of pixel data values when said first control voltage is applied.

43. A display system as in claim 24 further comprising an illuminator coupled to said display system, said illuminator providing at least one pulse of illumination which does not provide continuous illumination during the time that said second image is available for display.

44. A display system as in claim 43 wherein said second image is available for display while said second control voltage is applied.

45. A display system as in claim 40 further comprising:

a control device coupled to at least one of said pixel electrodes, said control device applying a first reference voltage to at least one of said pixel electrodes before said display system displays said second image, and wherein the application of said first reference voltage and the application of said first control voltage overlap at least partially in time.

46. A method for operating a display system, said display system comprising a first substrate having a plurality of pixel electrodes, an electro-optic layer operatively coupled to said pixel electrodes and an electrode operatively coupled to said electro-optic layer, said method comprising:

applying a first plurality of pixel data values to said plurality of pixel electrodes such that a first pixel data represented by said first plurality of pixel data values is displayed;

applying a first control voltage to said electrode to alter a state of said electro-optic layer such that said first pixel data is substantially not displayed;

applying a second plurality of pixel data values to said plurality of pixel electrodes, said second plurality of pixel data values representing a second pixel data;

displaying said second pixel data by applying a second control voltage to said electrode to alter said state of said electro-optic layer such that said second pixel data is displayed, and wherein at least one of said first control voltage, said second control voltage, and a pixel data value of said second plurality of pixel data values is determined by an illumination color used in displaying said second pixel data.

47. A method as in claim 46 wherein a first image is represented by said first pixel data and a second image is represented by said second pixel data and wherein said first image comprises a first color subframe for a first color and said second image comprises a second color subframe for a second color and wherein said illumination color is said second color.

48. A method as in claim 47 wherein said display system illuminates said electro-optic layer in a time sequential color manner with said first color, said second color and a third color.

49. A method as in claim 48 wherein said display system illuminates said electro-optic layer with at least one pulse of said illumination color which does not provide continuous illumination during a time that said second pixel data is available for display.

50. A method as in claim 49 wherein said second pixel data is available for display while said second control voltage is applied.

51. A method as in claim 48 wherein said display system comprises a liquid crystal disposed on a reflective semiconductor substrate and said plurality of pixel electrodes are reflective surfaces disposed on said reflective semiconductor substrate.

52. A method as in claim 48 wherein said electro-optic layer comprises a liquid crystal material and wherein said liquid crystal has at least a first light altering state and a second light altering state and wherein said first control voltage sets said liquid crystal in said first light altering state such that light substantially cannot pass through said display system and wherein said second control voltage allows said liquid crystal to be set in said second light altering state such that light is capable of passing through said display system and wherein said step of applying a first control voltage further comprises applying a third control voltage to said electrode after said first control voltage is applied to said electrode and before said step of applying said second control voltage, wherein said third control voltage substantially holds said liquid crystal in substantially said first light altering state and said first control voltage rapidly places said liquid crystal in substantially said first light altering state.

53. A method as in claim 52 wherein said third control voltage is determined by said illumination color.

54. A method as in claim 53 wherein said step of applying said third control voltage and said step of applying said second plurality of pixel data values overlap at least partially in time.

55. A method as in claim 46 wherein, after applying said second control voltage, said electro-optic layer relaxes to a plurality of gray scale or color levels corresponding to said second plurality of pixel data values and wherein a first capacitance between a pixel electrode and a reference electrode is larger than a second capacitance between said pixel electrode and said electrode.

56. A method as in claim 48 wherein for at least a set of pixels of said first pixel data, said electro-optic layer has not reached a steady state display level specified by said first pixel data when said first control voltage is applied.

57. A method as in claim 48 further comprising applying a first reference voltage to at least one of said pixel electrodes and wherein said applying said first reference voltage and said applying said first control voltage overlap at least partially in time.

58. A method as in claim 48 wherein said electrode is a cover glass electrode.

59. A display system comprising:

a first substrate having a first plurality of pixel electrodes for receiving a first plurality of pixel data values representing a first image to be displayed;

an electro-optic layer operatively coupled to said pixel electrodes;

an electrode operatively coupled to said electro-optic layer, said display system displaying said first image and then applying a first control voltage to said electrode to alter a state of said electro-optic layer such that said first image is substantially not displayed and then said display system displaying a second image represented by a second plurality of pixel data values after said electrode receives a second control voltage, wherein at least one of said first control voltage, said second control voltage, and a pixel data value of said second plurality of pixel data values is determined by an illumination color used in displaying said second image.

60. A display system as in claim 59 further comprising an illumination color dependent electrode driver coupled to said electrode, said illumination color dependent electrode driver determining for said illumination color said first control voltage and said second control voltage.

61. A display system as in claim 60 wherein said illumination color dependent electrode driver comprises a memory device which stores a lookup table which determines said second control voltage and said first control voltage for said illumination color.

62. A display system as in claim 59 further comprising an illumination color dependent pixel electrode driver coupled to said first plurality of pixel electrodes, said illumination color dependent pixel electrode driver determining for said illumination color said pixel data value.

63. A display system as in claim 60 further comprising an illumination color dependent pixel electrode driver coupled to said first plurality of pixel electrodes, said illumination color dependent pixel electrode driver determining for said illumination color said pixel data value.

64. A display system as in claim 63 wherein said illumination color dependent electrode driver comprises a digital-to-analog converter (DAC) which is coupled to said electrode and which converts digital values to analog values, wherein said analog values drive said electrode.

65. A display system as in claim 59 wherein said display system further comprises an illuminator which illuminates said electro-optic layer in a time sequential color manner with a first color, a second color and a third color.

66. A display system as in claim 65 wherein said first image comprises a first color subframe for said first color and said second image comprises a second color subframe for said second color and wherein said illumination color is said second color.

67. A display system as in claim 66 wherein said display system illuminates said electro-optic layer with at least one pulse of said illumination color which does not provide continuous illumination during a time that said second pixel data is available for display.

68. A display system as in claim 67 wherein said second pixel data is available for display while said second control voltage is applied to said electrode.

69. A display system as in claim 66 wherein said display system comprises a liquid crystal disposed on a reflective semiconductor substrate and said plurality of pixel electrodes are reflective surfaces disposed on said reflective semiconductor substrate.

70. A display system as in claim 66 wherein said electro-optic layer comprises a liquid crystal material and wherein said liquid crystal has at least a first light altering state and a second light altering state and wherein said first control voltage sets said liquid crystal in said first light altering state such that light substantially cannot pass through said display system and wherein said second control voltage allows said liquid crystal to be set in said second light altering state such that light is capable of passing through said display system and wherein said display system applies a third control voltage to said electrode after said first control voltage is applied to said electrode and before applying said second control voltage to said electrode, wherein said third control voltage substantially holds said liquid crystal in substantially said first light altering state and said first control voltage rapidly places said liquid crystal in substantially said first light altering state.

71. A display system as in claim 70 wherein said third control voltage is determined by said illumination color.

72. A display system as in claim 71 wherein application of said third control voltage and application of said second plurality of pixel data values overlap at least partially in time.

73. A display system as in claim 66 wherein, after said electrode receives said second control voltage, said electro-optic layer relaxes to a plurality of gray scale or color levels corresponding to said second plurality of pixel data values.

74. A display system as in claim 66 wherein for at least a set of pixels of said first pixel data, said electro-optic layer has not reached a steady state display level specified by said first pixel data when said first control voltage is applied.

75. A display system as in claim 66 further comprising a control device coupled to said electrode, said control device applies a first reference voltage to at least one of said pixel electrodes and wherein application of said first reference voltage and said applying said first control voltage overlap at least partially in time.

76. A display system as in claim 66 wherein said electrode is a cover glass electrode.

77. A method for operating a display system, said display system comprising a first substrate having a plurality of pixel electrodes, an electro-optic layer operatively coupled to said pixel electrodes and an electrode operatively coupled to said electro-optic layer, said method comprising:

applying a first plurality of pixel data values to said plurality of pixel electrodes such that a first pixel data represented by said first plurality of pixel data values is displayed;

applying a first control voltage to said electrode to alter a state of said electro-optic layer such that said first pixel data is substantially not displayed;

applying a second plurality of pixel data values to said plurality of pixel electrodes, said second plurality of pixel data values representing a second pixel data;

displaying said second pixel data by applying a second control voltage to said electrode to alter said state of said electro-optic layer such that said second pixel data is displayed, wherein a first image is represented by said first pixel data and a second image is represented by said second pixel data and wherein over time said electrode receives a composite signal and wherein a first parameter of at least one of said first control voltage and said second control voltage is selected to provide an offset, for a portion of said composite signal, from a DC balanced signal over time with respect to a particular voltage.

78. A method as in claim 77 further comprising compensating for said offset by selecting a second parameter of at least one of said first control voltage and said second control voltage.

79. A method as in claim 78 wherein said compensating substantially provides said DC balanced signal over time with respect to said particular voltage for said composite signal.

80. A method as in claim 79 wherein said offset provides substantially uniform response of said electro-optic layer independent of a polarity of electric fields generated across said electro-optic layer by said pixel electrodes and said electrode.

81. A method as in claim 79 wherein a voltage difference between said first control voltage and said second control voltage is selected to reduce capacitive shifting of said second plurality of pixel data values on said plurality of pixel electrodes.

82. A method as in claim 79 wherein said first control voltage is one of a high extreme and a low extreme and wherein said second control voltage is one of a high view extreme or a low view extreme and wherein when a maximum voltage across said electro-optic layer is desired for a frame or a subframe, a pixel electrode voltage, corresponding to one of said second plurality of pixel data values, is one of a high pixel extreme voltage or a low pixel extreme voltage, and wherein, when said maximum voltage across said electro-optic layer is desired during display of said second pixel data, said pixel electrode voltage is substantially at said low pixel extreme voltage when said second control voltage is substantially at said high view extreme and said first control voltage, for said frame or said subframe, was previously at said high extreme.

83. A method as in claim 82 wherein, when said maximum voltage across said electro-optic layer is desired during display of said second pixel data, said pixel electrode voltage is substantially at said high pixel extreme voltage when said second control voltage is substantially at said low view extreme and said first control voltage, for said frame or said subframe, was previously at said low extreme.

84. A method as in claim 79 wherein at least one of said first control voltage, said second control voltage, and a pixel data value of said second plurality of pixel data values is determined by an illumination color used in displaying said second pixel data.

85. A method as in claim 82 wherein at least one of said first control voltage, said second control voltage, and a pixel data value of said second plurality of pixel data values is determined by an illumination color used in displaying said second pixel data.

86. A method as in claim 83 wherein at least one of said first control voltage, said second control voltage, and a pixel data value of said second plurality of pixel data values is determined by an illumination color used in displaying said second pixel data.

87. A method as in claim 85 wherein said first image comprises a first color subframe for a first color and said second image comprises a second color subframe for a second color which is said illumination color.

88. A method as in claim 79 wherein said step of applying said first control voltage and said step of applying said second plurality of pixel data values overlap at least partially in time.

89. A method as in claim 88 wherein said electrode is a cover glass electrode.

90. A method as in claim 89 wherein said display system comprises a liquid crystal disposed on a reflective semiconductor substrate and said plurality of pixel electrodes are disposed on said reflective semiconductor substrate.

91. A method as in claim 79 wherein said electro-optic layer comprises a liquid crystal material and wherein said liquid crystal has at least a first light altering state and a second light altering state and wherein said first control voltage sets said liquid crystal in said first light altering state such that light substantially cannot pass through said display system and wherein said second control voltage allows said liquid crystal to be set in said second light altering state such that light is capable of passing through said display system and wherein said step of applying a first control voltage further comprises applying a third control voltage to said electrode after said first control voltage is applied to said electrode and before said step of applying said second control voltage, wherein said third control voltage holds said liquid crystal in substantially said first light altering state and said first control voltage rapidly places said liquid crystal in substantially said first light altering state.

92. A method as in claim 91 wherein said step of applying said third control voltage and said step of applying said second plurality of pixel data values overlap at least partially in time.

93. A method as in claim 92 wherein said step of applying said third control voltage and said step of applying said second plurality of pixel data values occur substantially contemporaneously.

94. A method as in claim 77 wherein after applying said second control voltage, said electro-optic layer relaxes to a plurality of gray scale or color levels corresponding to said second plurality of pixel data values and wherein a first capacitance between a pixel electrode and a reference electrode is larger than a second capacitance between said pixel electrode and said electrode.

95. A method as in claim 94 wherein for at least a set of pixels of said first pixel data, said electro-optic layer has not reached a steady state display level specified by said first pixel data when said first control voltage is applied.

96. A method as in claim 79 further comprising illuminating said display system with at least one pulse of illumination which does not provide continuous illumination during the time that said second pixel data is available for display.

97. A method as in claim 96 wherein said second pixel data is available for display while said second control voltage is applied.

98. A method as in claim 92 further comprising applying a first reference voltage to at least one of said pixel electrodes and wherein said step of applying said first reference voltage and said step of applying a first control voltage overlap at least partially in time.

99. A display system comprising:

a first substrate having a first plurality of pixel electrodes for receiving a first plurality of pixel data values representing a first image to be displayed;

an electro-optic layer operatively coupled to said pixel electrodes;

an electrode operatively coupled to said electro-optic layer, said display system displaying said first image and then applying a first control voltage to said electrode to alter a state of said electro-optic layer such that said first image is substantially not displayed and then said display system displaying a second image represented by a second plurality of pixel data values after said electrode receives a second control voltage;

an electrode driver coupled to said electrode, wherein over time said electrode receives a composite signal and wherein a first parameter of at least one of said first control voltage and said second control voltage is selected to provide an offset, for a portion of said composite signal, from a DC balanced signal over time with respect to a particular voltage.

100. A display system as in claim 99 further comprising:

a compensator coupled to said electrode driver, said compensator compensating for said offset by selecting a second parameter of at least one of said first control voltage and said second control voltage.

101. A method as in claim 100 wherein said compensator comprises a lookup table and substantially provides said DC balanced signal over time with respect to said particular voltage for said composite signal.

102. A method as in claim 101 wherein said offset provides substantially uniform response of said electro-optic layer independent of a polarity of electric fields generated across said electro-optic layer by said pixel electrodes and said electrode.

103. A display system as in claim 101 wherein a voltage difference between said first control voltage and said second control voltage is selected to reduce capacitive shifting of said second plurality of pixel data values on said plurality of pixel electrodes.

104. A display system as in claim 101 wherein at least one of said first control voltage, said second control voltage, and a pixel data value of said second plurality of pixel data values is determined by an illumination color used in displaying said second pixel data.

* * * * *